US005956764A

United States Patent [19]

Sabin

[11] Patent Number: 5,956,764

[45] **Date of Patent: *Sep. 28, 1999**

[54] AERODYNAMIC SYSTEM FOR BICYCLISTS

[76] Inventor: Robert Sabin, Goosedown Estate, Box 332, Horses Road, Long Island, N.Y. 11765

[ * ] Notice: This patent is subject to a terminal disclaimer.

[21] Appl. No.: 08/842,232

[22] Filed: Apr. 22, 1997

Related U.S. Application Data

[63] Continuation-in-part of application No. 08/697,362, Aug. 23, 1996, Pat. No. 5,873,131, which is a continuation-in-part of application No. 08/688,188, Jul. 29, 1996, abandoned, which is a continuation-in-part of application No. 08/635,595, Apr. 22, 1996, abandoned.

[51] Int. Cl.[6] ..... A41B 1/00

[52] U.S. Cl. ..... 2/69; 2/115

[58] Field of Search ..... 2/69, 115, 113, 2/114, 106, 105, 93, 85, 94, 88, 16, 79; 280/841, 11.19, 11.3, 809, 811, 24, 32.7

[56] References Cited

U.S. PATENT DOCUMENTS

| | | |
|---|---|---|
| D. 351,493 | 10/1994 | DeCinque . |
| 766,613 | 8/1904 | Greene . |
| 2,213,754 | 9/1940 | Thirring . |
| 4,220,299 | 9/1980 | Motter . |
| 5,371,903 | 12/1994 | Lew . |
| 5,406,647 | 4/1995 | Lew . |
| 5,412,813 | 5/1995 | Hosley . |

*Primary Examiner*—Gloria Hale
*Attorney, Agent, or Firm*—Fish & Richardson P.C.

[57] ABSTRACT

A garment is provided for aerodynamic assistance or propulsion of a rider-propelled wheeled vehicle comprising sail-like extensions extending from the abdominal portion of the garment and secured at a point between the hand and about the elbow of the rider while gripping the handle bars of the vehicle.

24 Claims, 27 Drawing Sheets

AERODYNAMIC SYSTEM FOR BICYCLISTS

CROSS REFERENCE TO RELATED APPLICATIONS

This is a continuation-in-part of Ser. No. 08/697,362, filed Aug. 23, 1996, now U.S. Pat. No. 5,873,131 which is a continuation-in-part of Ser. No. 08/688,188, filed Jul. 29, 1996, (now abandoned) which is a continuation-in-part of Ser. No. 08/635,595 filed Apr. 22, 1996 (now abandoned).

BACKGROUND OF THE INVENTION

The present invention is directed to a garment for aerodynamic assistance of the propulsion of a rider-propelled wheeled vehicle. The garment is intended for use by recreational, mountain, touring or racing bicyclists. The garment enhances aerodynamic efficiency of the rider when directed into head winds or against cross winds, and provides additional thrust to propel the vehicle and rider, serving as sails, in cross winds or tail winds.

The bicyclist continues to find means and devices to propel him faster or to maintain speed with less effort. While this may be attained by using lighter materials, such as titanium, aluminum, specialty steel frames and carbon fiber, the only other alternative is to enhance the aerodynamic efficiency of the rider and bicycle. Such devices as aero handle bars, aero frames, aero wheels, aero brakes, aero cable routing, aero helmets, aero skin suits and the like have been developed to accomplish this. However, in spite of the dedication of technology and investment on items to improve the aerodynamics of the bicycle and to deal with the problem of weight, the rider is still the greatest source of aerodynamic drag. Typically the rider represents about 64% of the aerodynamic drag and the bicycle represents 21%, with the remainder being due to wheels, spokes, tires, rolling and frictional resistance.

An essential factor in relation to the physics governing cycling is that the total resistance to forward movement on a bicycle is a direct function of the square of the speed. Thus, doubling a rider's speed increases the total resistance to forward movement four-fold. Furthermore, there is a disproportionately greater increase in total resistance when a cyclist increases his speed, for example, from 40 to 42 kph as compared to increasing his speed from 20 to 22 kph. Air resistance is the primary element of the total resistance that causes this increase in total resistance, since at such speeds difference in frictional components of resistance is small. For example, at a 10 kph riding speed the air resistance contributes less than 20% of the total resistance to forward movement encountered by the cyclist. At speeds of 20 and 40 kph air resistance increases to 54% and 82%, respectively, of the total resistance, with rider drag being the major component of the total resistance and of the total air resistance.

To deal with the aero dynamic drag of the rider, there are aero skins, aero glasses and aero helmets, as well as improved rider aerodynamic positions with or without using aero bars.

The present invention provides a method for not only improving the aerodynamics of the rider, but also to utilize the prevailing winds to assist in the propulsion of the bicycle.

SUMMARY OF THE INVENTION

The present invention provides a garment for aerodynamic assistance and propulsion of a rider-propelled wheeled vehicle, comprising an abdominal portion securely attached to the abdomen of the rider, one and preferably two, unfurled triangular-shaped extensions from the abdominal portion wherein each extension is joined at its base, respectively, to the abdominal portion along a line extending approximately from each shoulder blade to or below the waist of the rider to form wing-like shapes. Each apex of the triangular shaped extension accommodates a loop for affixing the extension to a digit of a hand of the rider, to the forearm or to the upper arm just above the elbow, depending upon the size of the extension, to retain the extension in an unfurled position.

DESCRIPTION OF THE PREFERRED EMBODIMENTS

An advantage of the present invention is that, under influence of certain directions of the wind, the device provides a positive thrust to assist the bicyclist in propelling the bicycle either to move the bicycle at a faster pace or to maintain a speed with less effort by the bicyclist. In a direct head wind, the present invention can improve the aerodynamic efficiency of the rider, but would not add a positive thrust to propel the bicyclist.

According to the invention under the influence of certain directions of the wind, the cyclist may unfurl the device to provide an aerodynamic configuration about this upper torso on demand. The capability of using the device when conditions are advantageous, and storing the device when they are not, is an advantage over other aerodynamic devices for cyclists. Other aero-dynamic devices such as aero-frame sets are fixed for maximizing efficiency in the forward direction, but may increase drag and promote aero-dynamic inefficiency under the influence of different directions of the wind. Unlike other bicycling aero devices such as aero-wheels, aero-frames, aero-bars and aero-brakes the device of the present invention is infinitely adjustable on demand, to optimize the lessening of aero-dynamic drag, which optimizes positive thrust of the cyclist. This is accomplished by the cyclist interfacing his elbow, upper arm and forearm with the device of invention while flexing the elbow outward to optimize wind conditions to his advantage alone or in conjunction with changing arm positions on the handlebars or in conjunction with aero-bars.

The device of the invention may be stored in itself when not in use, or stored in a pocket or other receptacle. Another advantage of the present invention is the extreme light weight of the wing-like parts of the invention —weighing typically less than 5 ounces per 2 extensions. A typical aero-bar weighs over 1 pound. Another advantage of the present invention is that by blocking some of the air flow which would normally impact the cyclist's chest, stomach and upper body it promotes and increases the stability of the cyclist and the bicycle. By contrast, aero-bars, for example, are inherently less stable than conventional handlebars, and many aero-wheels are inherently less stable than conventional wheels in cross-winds and are much heavier, thus they are detrimental when climbing hills or inclines due to their increased weight.

Figure 1:
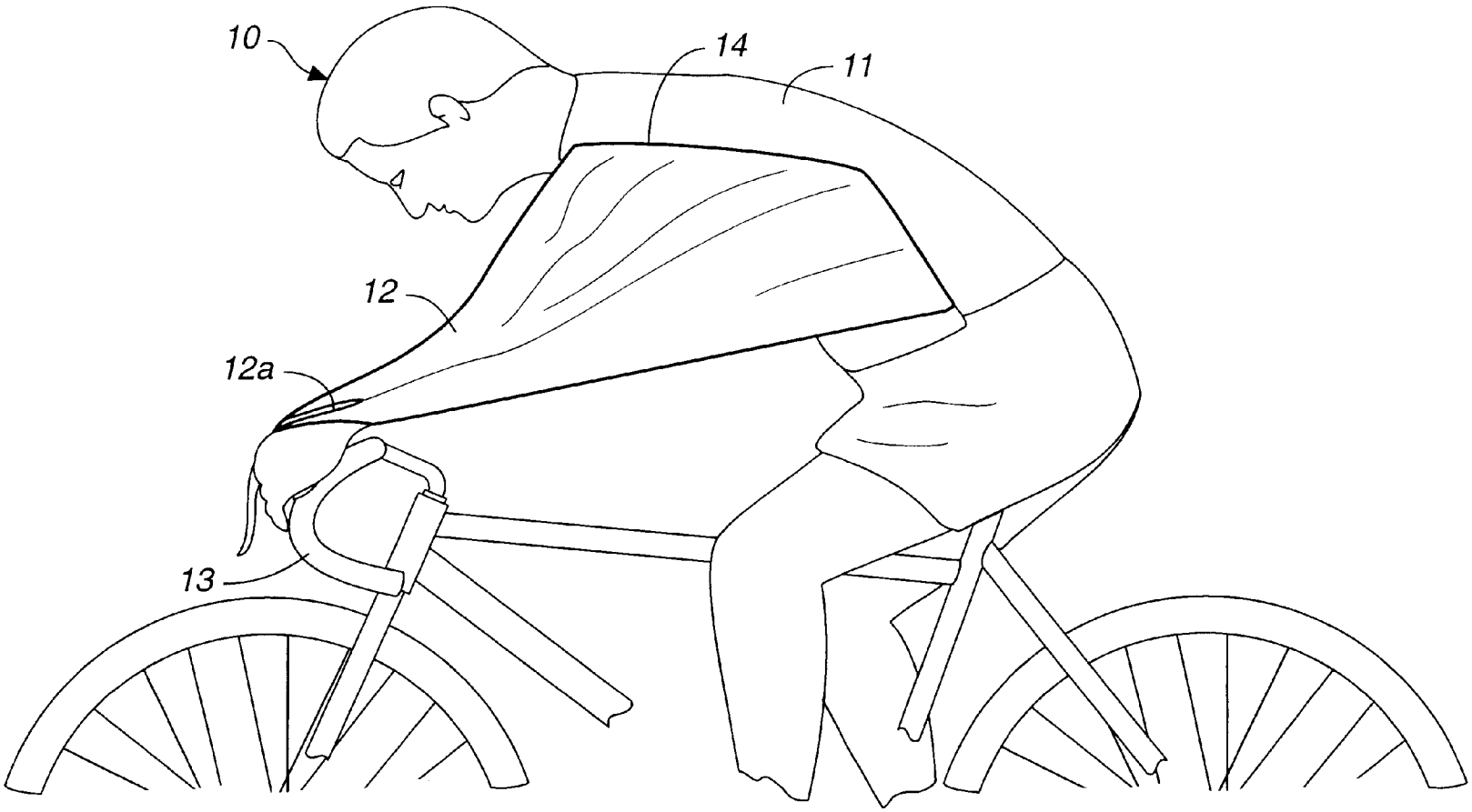
FIG. 1 is a partial side view of a rider on a bicycle showing the garment of the invention in an unfurled position.

Referring to the figures, in FIG. 1 there is shown a rider 10 wearing a garment comprising an abdominal portion 11, which is secured tightly around the rider's abdomen. Attached to the abdominal portion 11 on each side, there is a triangular extension 12 attached at its base 14 to the abdominal portion 11. The apex 12A of the triangular extension 12 is at such a distance from base 14 as to completely unfurl the extension 12 when the apex 12A is at or near the hand of the rider when gripping handle bars 13. There may be elastic bands or drawstrings (not shown) along the unattached edges of extension 12 to keep the extension taut and to assist in furling for storage.

Figure 2:
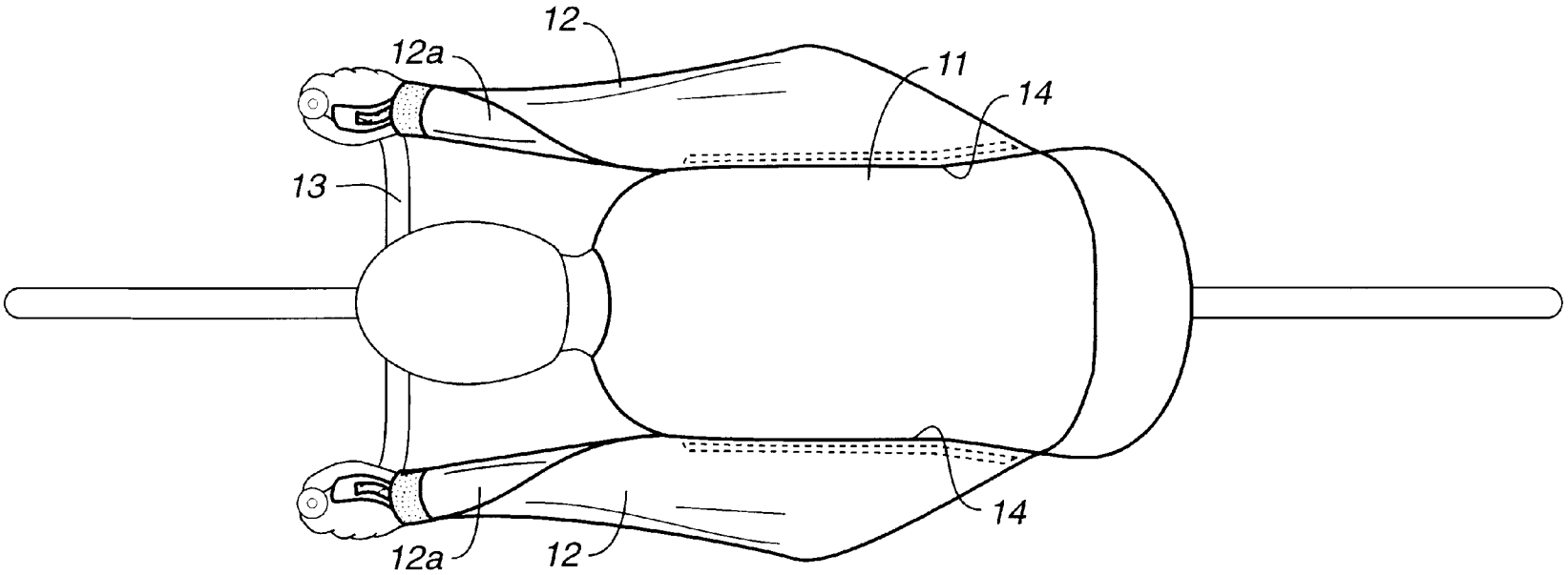
FIG. 2 is a top view of a rider on the bicycle showing the garment of the invention in an unfurled position.

Referring to FIG. 2, there shown a view of the rider and both of the triangular extensions 12 attached at their respective bases 14, approximately along the line extending from each shoulder blade down to the waist of the rider. The apices 12A of each extension 12 are held at the respective hands of the rider while gripping the handle bars 13 as described in more detail below.

Figure 3:
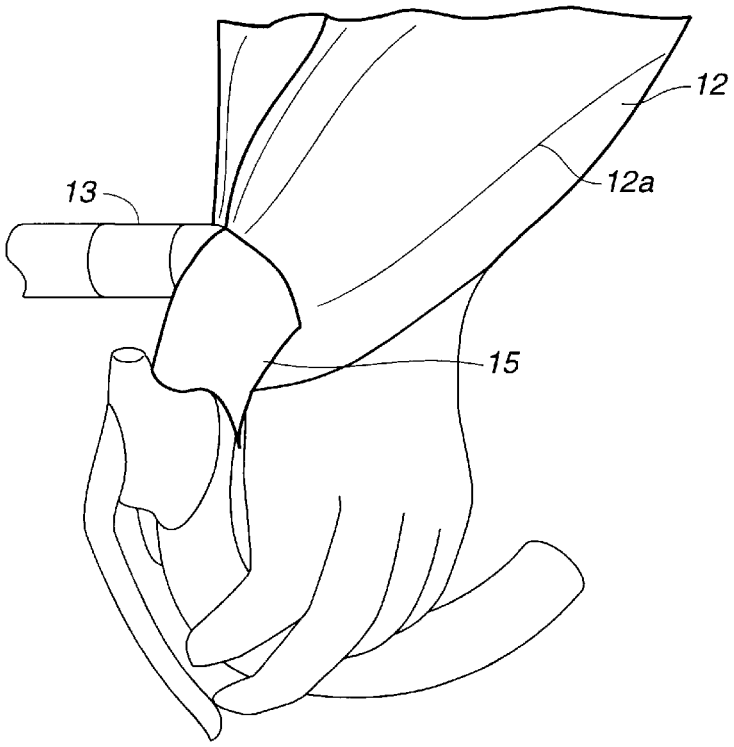
FIG. 3 is a detailed view of one hand of the rider securing the unfurled garment in an extended position while gripping the handle bars.

Referring to FIG. 3, there shown a detailed view of a preferred method of retaining the extension 12 in a unfurled position. At or near the apex 12A of the unfurled extension 12 is a loop 15 which can be secured by a digit of the rider while gripping the handle bars 13.

Figure 4:
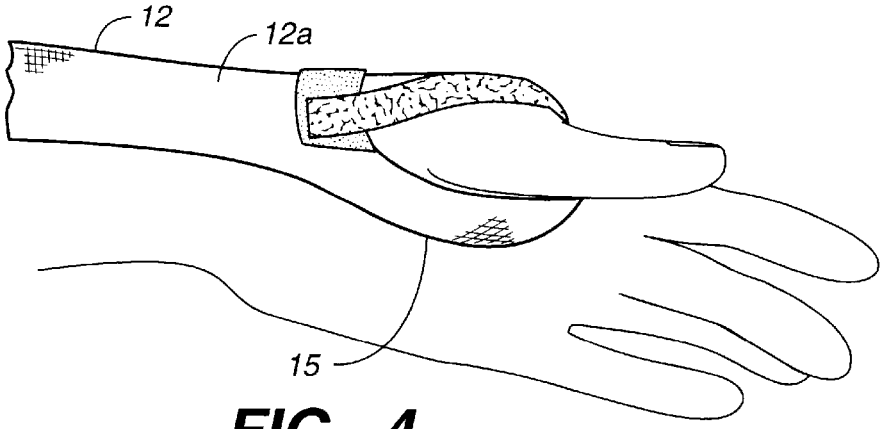
FIG. 4 is a detailed view of the loop at the apex of the unfurled extension secured by the thumb of the rider.

Referring to FIG. 4, the loop 15 is shown gripped by the thumb of the rider.

Figure 5:
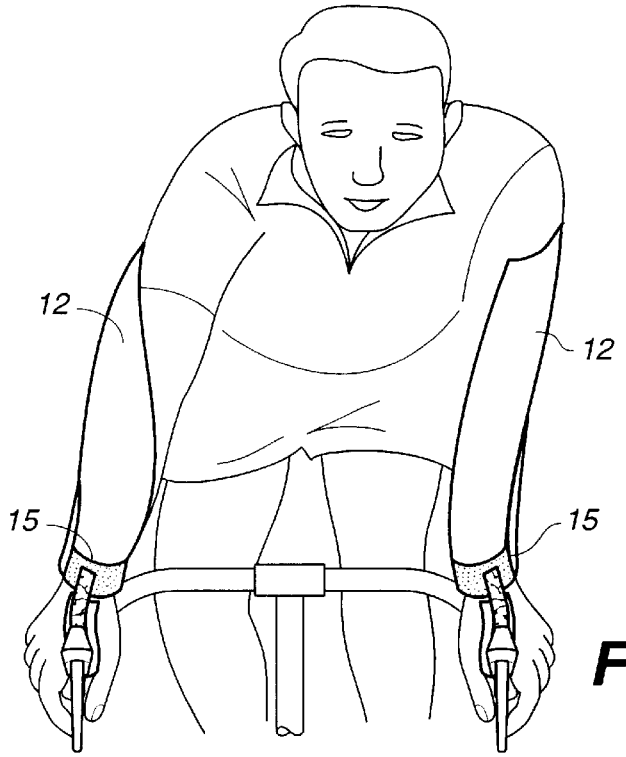
FIG. 5 is a front view of a rider securing the garment of invention in an unfurled position while gripping the handle bars.

Referring to FIG. 5, there shown a front view of a rider holding the extensions 12 in unfurled position. A portion of each extension 12 is shown wrapped around the each forearm of the rider. This further secures the extension 12 from flapping or having undue billowing. Moreover, in a head wind, this configuration serves to deflect the wind around the forearm and upper arm, thus this decreases the aerodynamic drag on those areas of the body.

Figure 6:
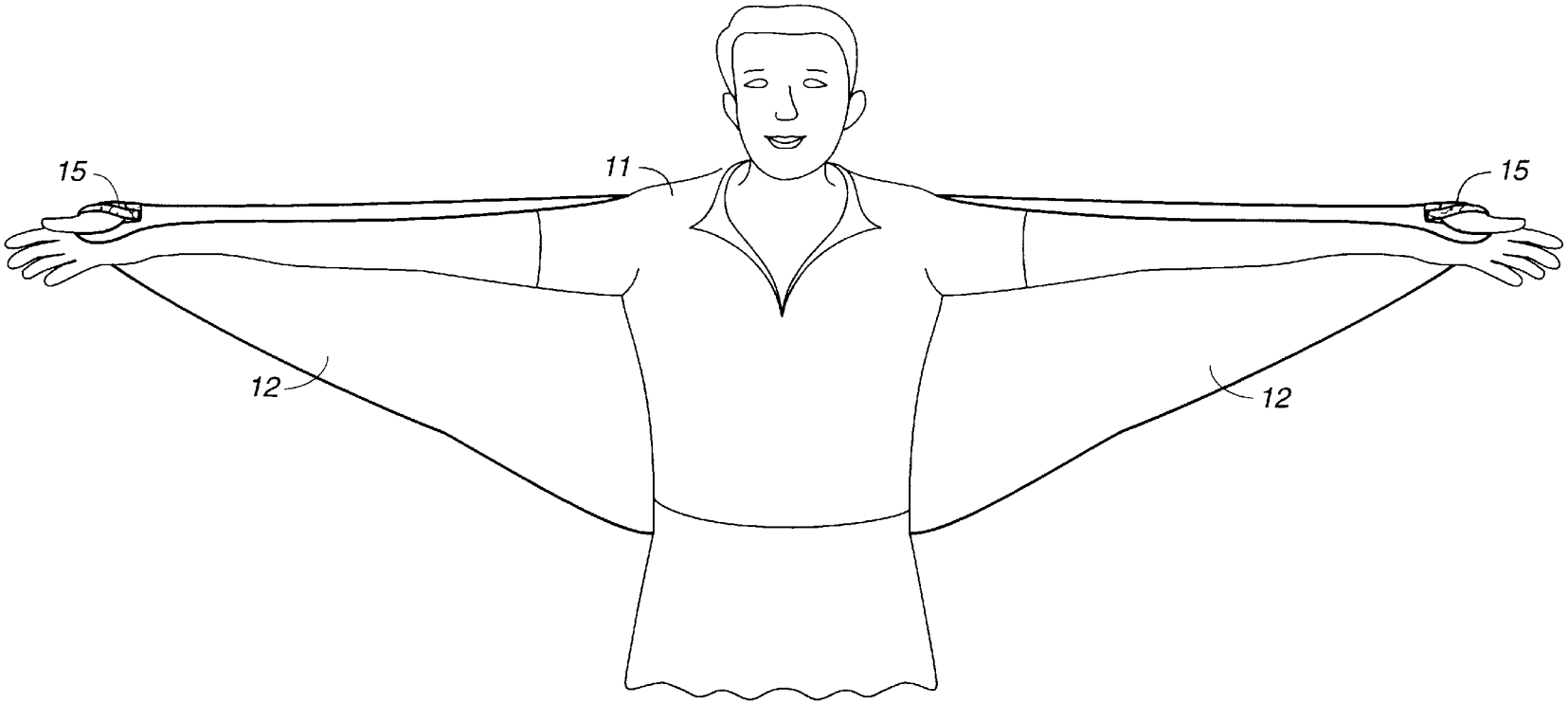
FIG. 6 is a front view of a rider standing with arms extended laterally to show the area of the garment in an unfurled position.

Referring to FIG. 6, the subject is shown wearing the garment and the abdominal portion 11 and having his arms extended outwardly to show the area of the two extensions 12.

Figure 7:
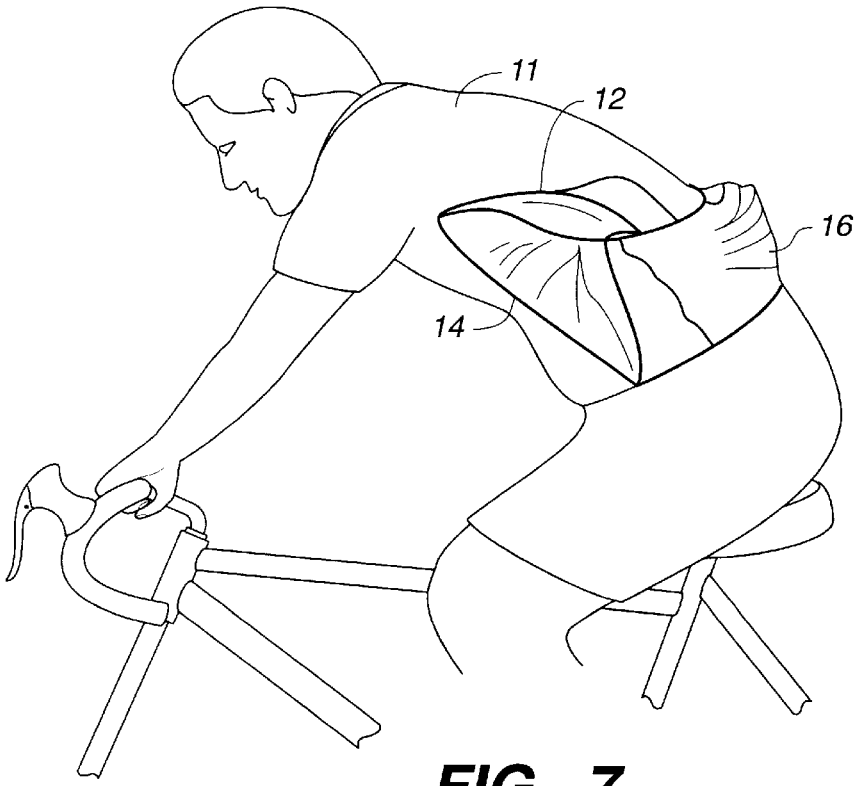
FIG. 7 is a side view of a rider on a bicycle showing one embodiment of storage of the furled device while riding.

Referring to FIG. 7, there shown one embodiment of storage of the extension 12 while riding. In this embodiment a back pocket 16 is provided into which each extension 12 is stored by folding at the apex 12A towards the base 14 interface. Then the folded portion is inserted into the pocket 16.

The extensions 12, when extended, form a sail like device. This is preferably made of DACRON® sail material, or other suitable material, sewn approximately from the shoulder blade to or below the waist of the rider at the end of the abdominal portion of the garment. The extensions 12 ay also be made of an elastic material—a preferred elastic material is DARLEXX® style #3611 with a warp of 207% and a side of 113% each, or have an expandable structure, such as, accordion-like folds. Alternatively, and not shown, a long sleeve shirt may comprise the abdominal portion. It is not necessary that the base of the triangular portion of the extension 12 start exactly at the shoulder or terminate exactly at the waist of the rider but the length of the base need only be of a sufficient length to form suitable sail shape.

Figure 8:
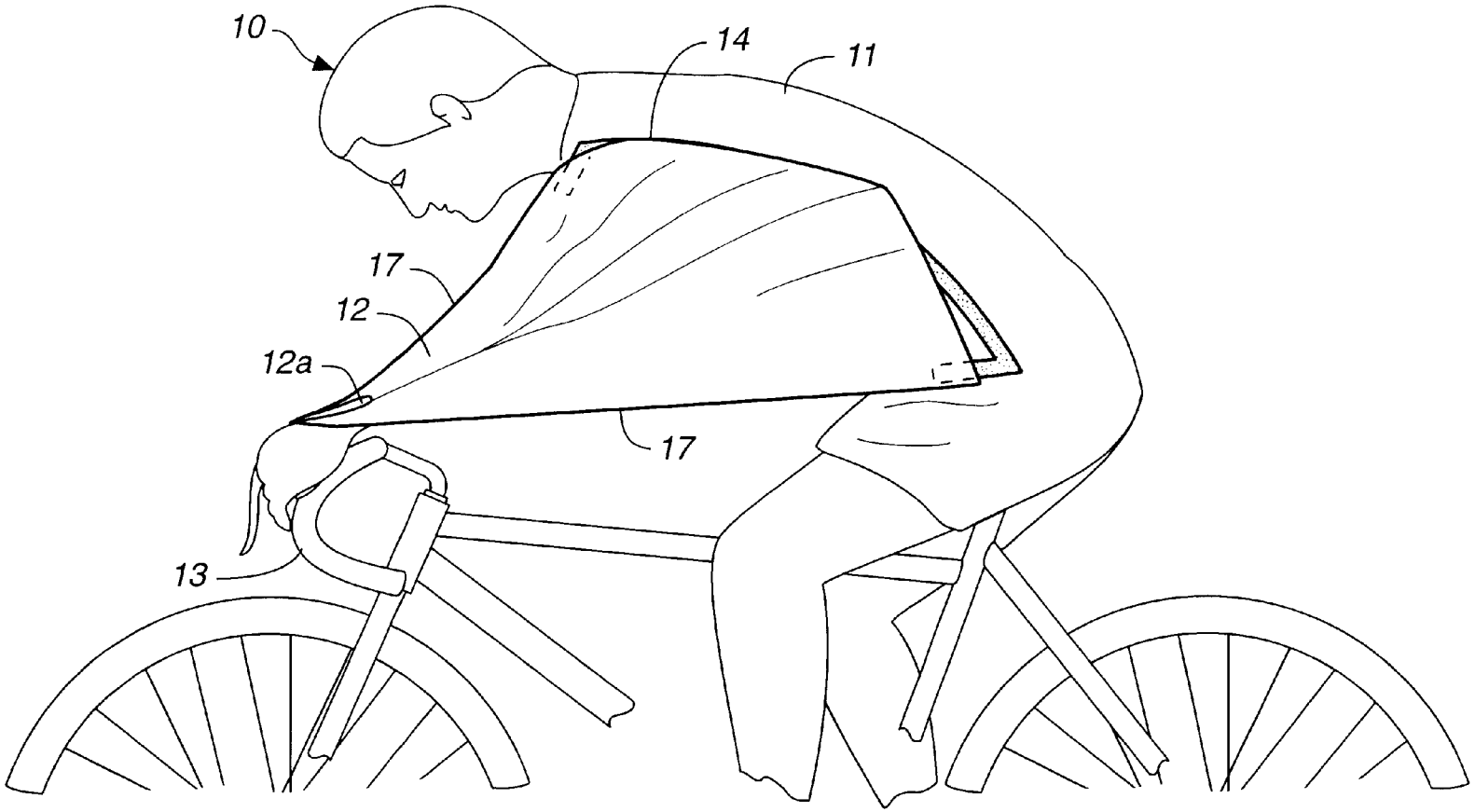
FIG. 8 is a side view of a rider showing a garment of the invention extending below the waist in an unfurled position.

Referring to FIG. 8, there is shown an embodiment of the garment where extension 12 extend below the waist and above the shoulder. There are also elastic bands 17 sewn into the unattached edges of extension 12 (subject to the elastic material used).

Another function of the extensions 12 is to enhance aerodynamic efficiency in a head wind. In the case of a head wind, the bicyclist may go into a low (so called "aero") position bringing his wrists in with the extensions 12 to maximize the aerodynamic efficiency by having the air pass over the extension instead of being caught in the chest cavity. This can also be accomplished with aero bars, which are narrow and require that the hands be held close together. The extensions may also be used in conjunction/simultaneously with aero-bars to further promote aerodynamic efficiency and lessen drag.

In the case of a cross-wind, the bicyclist may extend his elbows outwardly, separately or together with the extensions attached to catch the wind to provide thrust. Under these conditions there may be slight bend in the extension at the elbow to allow the bicyclist to flex the extension to maximize the wind condition and thrust derived from the wind. This is analogous to the "reach" position in utilizing the sail on a sail boat, or to the flexing of muscles in the wings by birds to make slight adjustments to optimize lifting forces of the air. Thus, by flexing the interface between the elbow and the extension, the rider can induce the maximum or minimum effects of practically all different cross wind conditions. This is accomplished also in conjunction with moving his hands to different positions on the handle bars. Due to the size of the extensions, by using extensions with different colors or fluorescent coloring, the visibility of the rider is enhanced to drivers of motor vehicles. The extensions are light weight. A typical DACRON® used for sailing is about 3.8 oz. per yard which equates to about 1 ½ to 3 oz. per extension, or about 3+ oz. per jersey, shirt or garment to which the extensions are attached. A preferred elastic material is DARLEXX® 3611 which weighs 6.5 oz. per yard or about 2 to 3+ oz. per extension or about 4 to 6+ oz. per garment to which the extensions are attached. Another preferred elastic material is TRIUMPH® made by Warshow & Sons.

As shown in FIG. 7, a typical bicycle jersey has a back pocket so the extensions can be stored in such pockets. However, the furled extensions may be stored other ways such as by attaching frictional tapes, VELCRO®, at the apices of the extensions and on appropriate locations on the abdominal portion of the garment. The furled extensions may also be stored under the arms in front pockets of the chest or stomach of a jersey, or under the arms, across the front chest under straps. The furled extension may also be stored by rolling and storing on the shoulder or upper arm after unzipping or detaching frictional tape. A racing skin-type suit may do away with storage all together and just have extensions without pockets. Snaps, button and button holes, and other methods of attachments may also be used. Typically, when in use, the hands of the rider will be on the handle bars next to brake and shifters or on the brake hoods or drops or mountain bike handle bar grips. This induces safety to the bicyclist since his hands are near the controls of the bicycle. Safety will also be promoted by striking colors or any color used on the invention/extensions, especially when signalling for turns. In the case of typically sized persons, the extensions will provide approximately 2 square feet or more of sail area or aero dynamic promoting area per extension for a total of approximately 4 square feet. This can be advantageously used to propel the bicycle in cross-winds.

Figure 9:
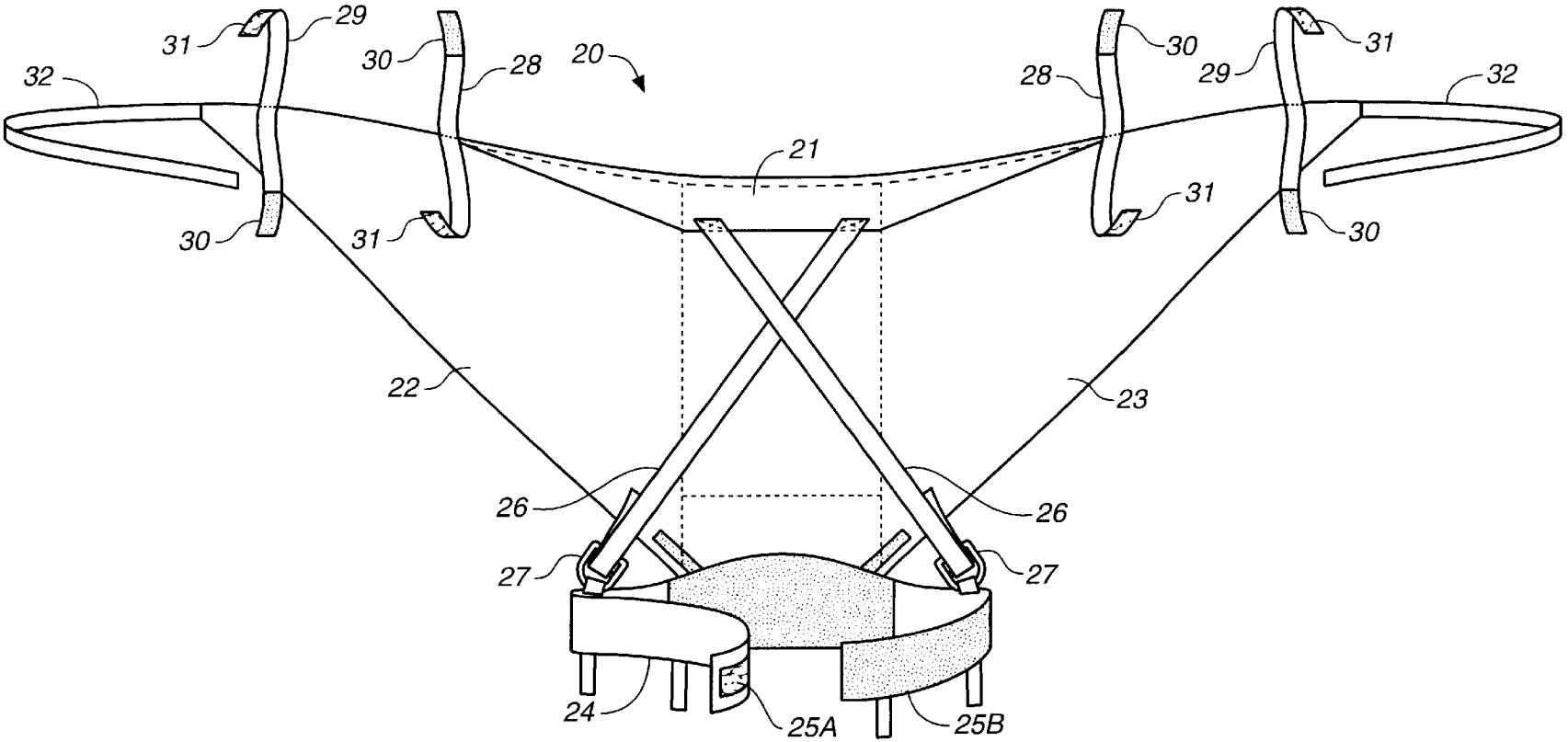
FIG. 9 is a front view of another embodiment of the invention.

FIG. 9 shows another embodiment of the invention. The garment 20 comprises an approximately triangular-shaped cloth piece comprising a back portion 21 which is intended to be in contact with the rider's back and two portions 22 and 23 which form wing-like extensions. Attached to the bottom of the back portion 21 is a belt 24 for securing to the waist of the rider. As shown, the belt has frictional tape surfaces 25A and 25B for securing the belt around the rider's waist and for adjusting the length of the belt. Shoulder straps 26 are attached to the back portion 21 and are securable to the belt 24 by receiving buckles 27. The shoulder straps 26 are also adjustable in length by frictional surfaces (not shown). The upper portion of the wing-like extensions 22 and 23 are accommodated with arm straps 28 and wrist straps 29, the ends of each which are, respectively, provided with frictional tape surfaces 30 which interlock with receiving frictional tape surfaces 31. At the end of the wing-like extensions 22 and 23 are straps 32 which are securable at their ends to form loops for accommodating the hands of the riders. The end of the loops 32 are provided with frictional tape surfaces (not shown).

Figure 10:
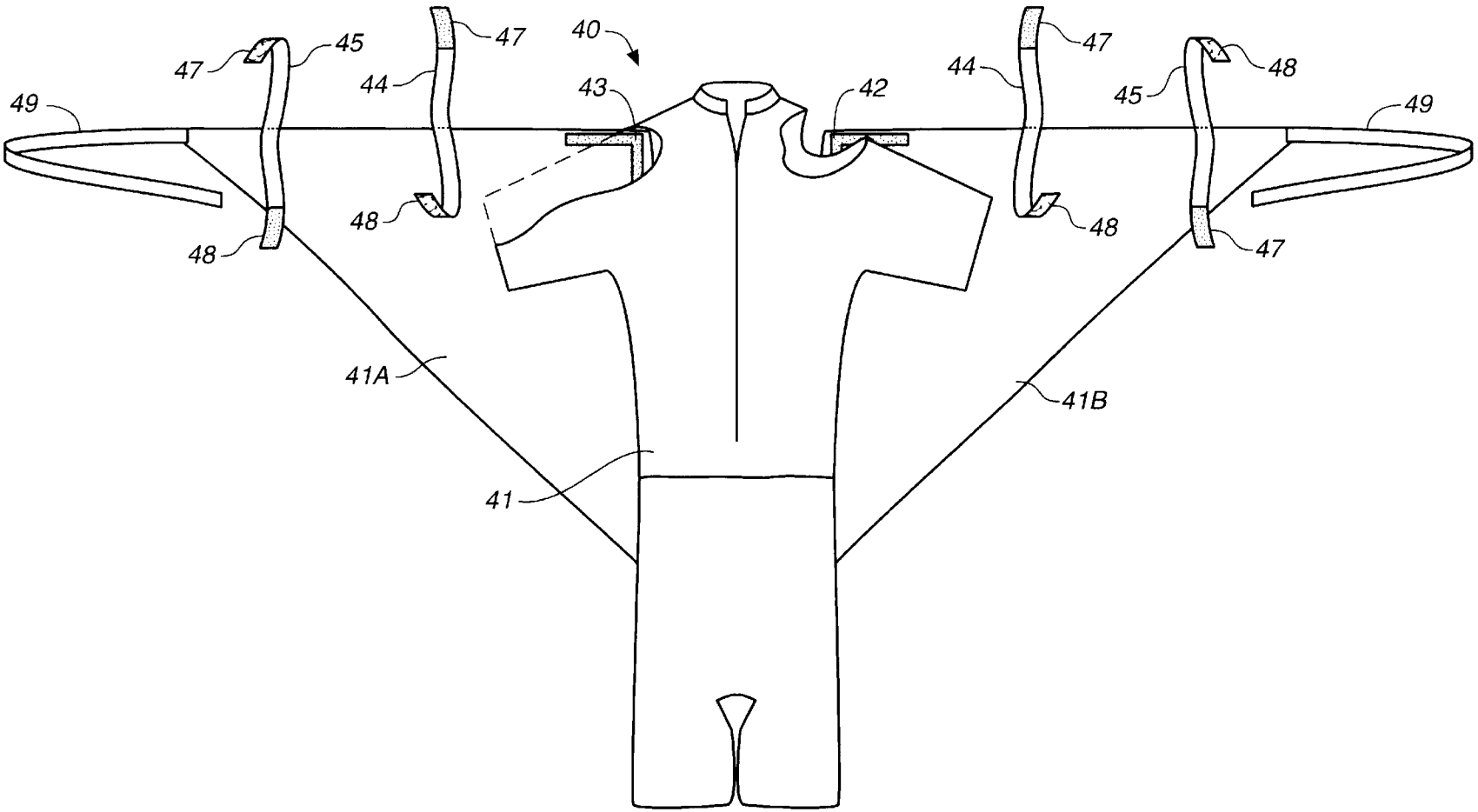
FIG. 10 is a front view of an embodiment of the invention showing attachment straps fixed to the garment.

Referring to FIG. 10, there is shown another embodiment 40 of the invention. The garment comprises an abdominal suit 41 to which is attached at the back two wing-like extensions 41A and 41B. For purposes of illustration, the wing-like attachments 41A and 41B are shown to be attached by two different means to the abdominal suit 41. Extension 41A is attached by a zipper 43 and extension 41B is attached by frictional tape, one surface of which is shown as 42. It will be understood that both extensions 41A and 41B can be attached by zipper or both can be attached by frictional tape, or other attachment means for securing to the abdominal suit 41. The upper portion of the extensions 41A and 41B are accommodated with arm attachment straps 44 and wrist attachment straps 45. Each of the straps 44 and 45 are attached to their respective interlocking frictional tape ends 47 and 48. The end of the extensions 41A and 41B are provided with straps 49 which can be attached at their respective ends to form loops to accommodate the rider's hands. The ends of the straps 49 are provided with frictional tape (not shown).

Figure 11:
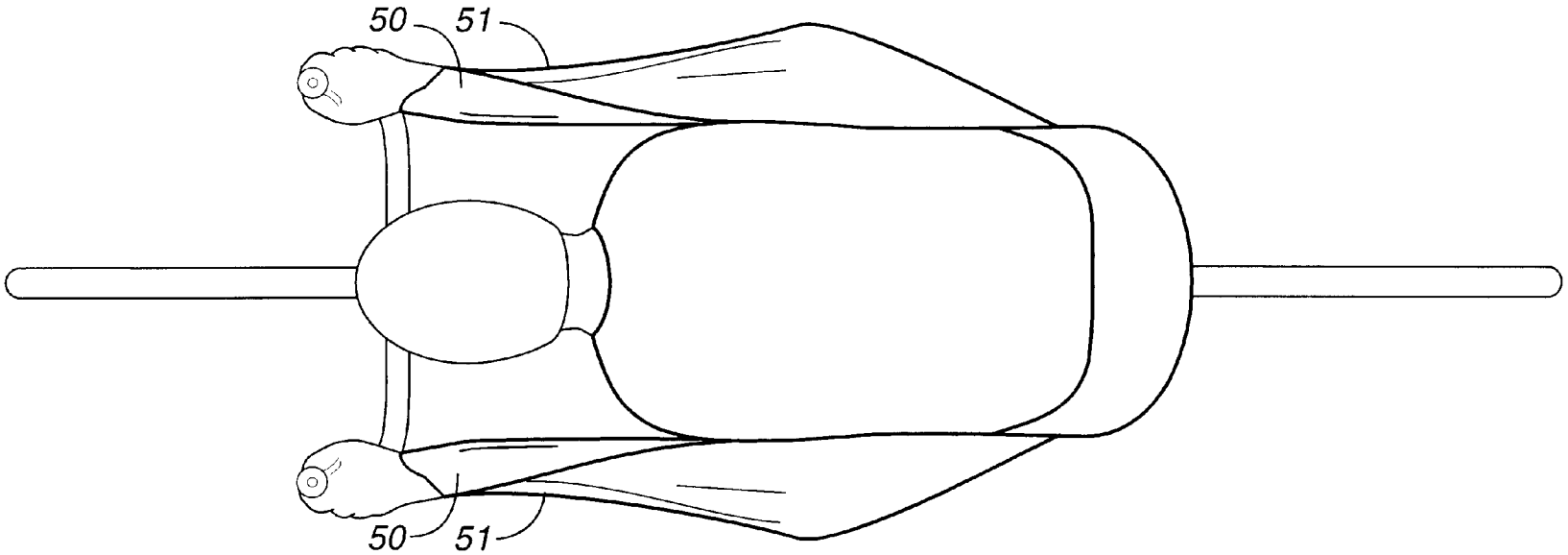
FIG. 11 is a top view of a rider on a bicycle showing the unfurled garment attached to the arms and wrists.

Referring to FIG. 11, there is a top view of a rider which shows detail of the attachment of wrist straps 50 and arm straps 51 to secure the wing-like extensions, 41A, 41B, 22 and 23, to the rider.

Figure 12:
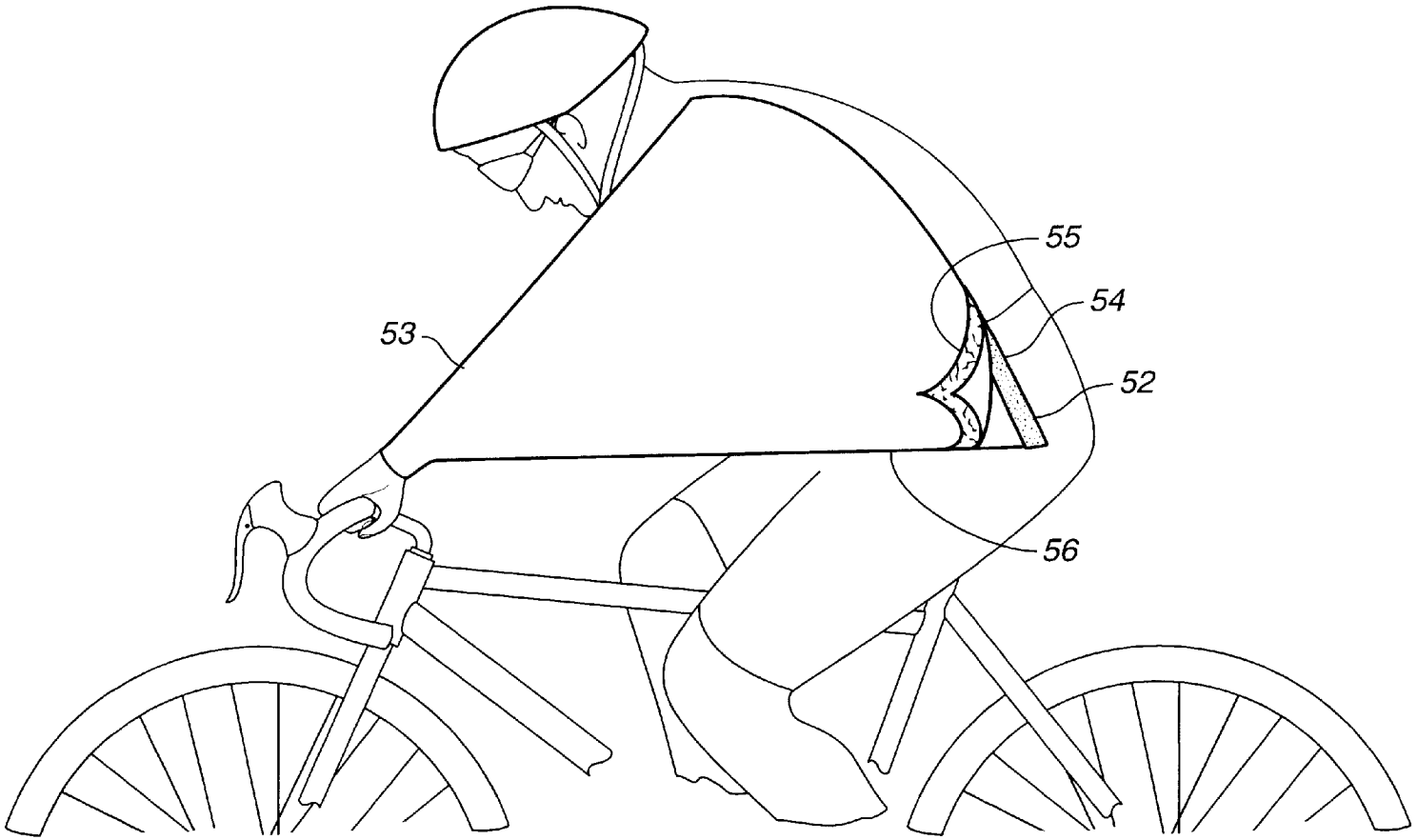
FIG. 12 is a side view of a rider showing the wing-like extensions of a garment according to the invention attached to the abdominal portion of the garment by frictional tape.

Referring to FIG. 12, there is shown the attachment of the wing-like extension 53 to an abdominal garment 52 by frictional tape surfaces 54 and 55. As shown, the bottom edge may be detached and reattached for several inches in order to provide an adjustment of the length of the lower edge 56 of the wing-like extension 53 to accommodate the different arm lengths and riding positions of riders.

Figure 13:
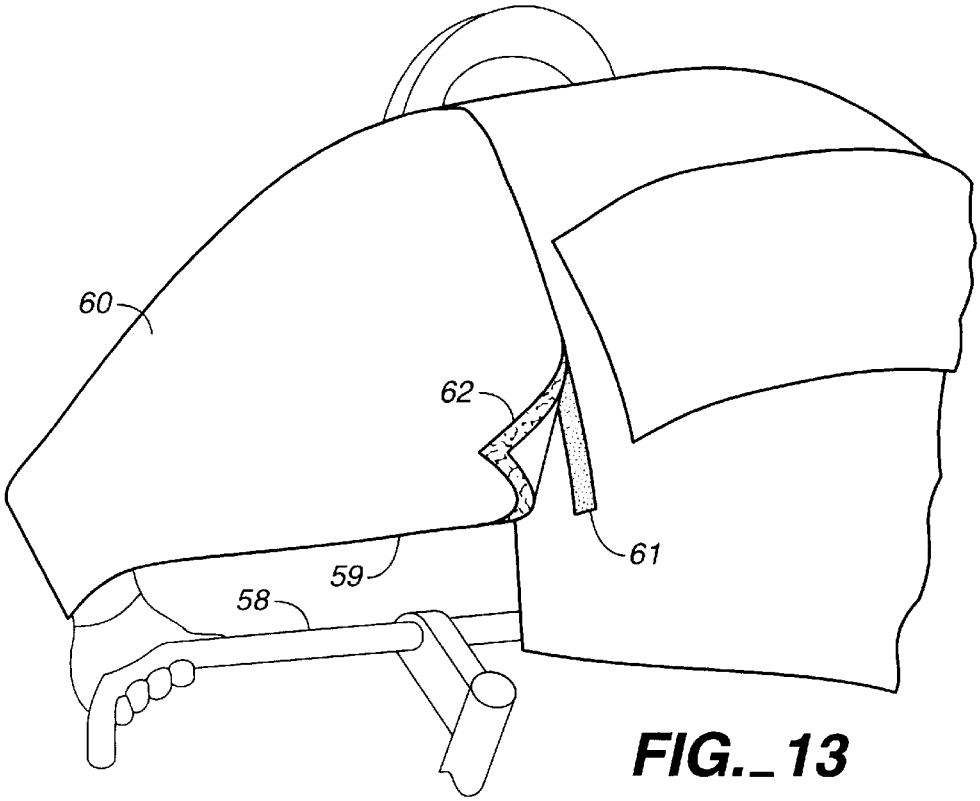
FIG. 13 is a detailed view of the attachment of the wing-like extensions to the abdominal portion of the garment by frictional tape.

Referring to FIG. 13, there is shown an arm of a rider where the hand is located on the outer portion of the handle bar 58. The lower edge 59 of the wing-like extension 60 has been adjusted for several inches in order to provide an adjustment of the length of the lower edge 59 of the wing-like extension 60 to accommodate the different arm lengths and riding positions of riders by detachment and reattachment of several inches of the interlocking frictional tape surfaces 61 and 62.

Figure 14:
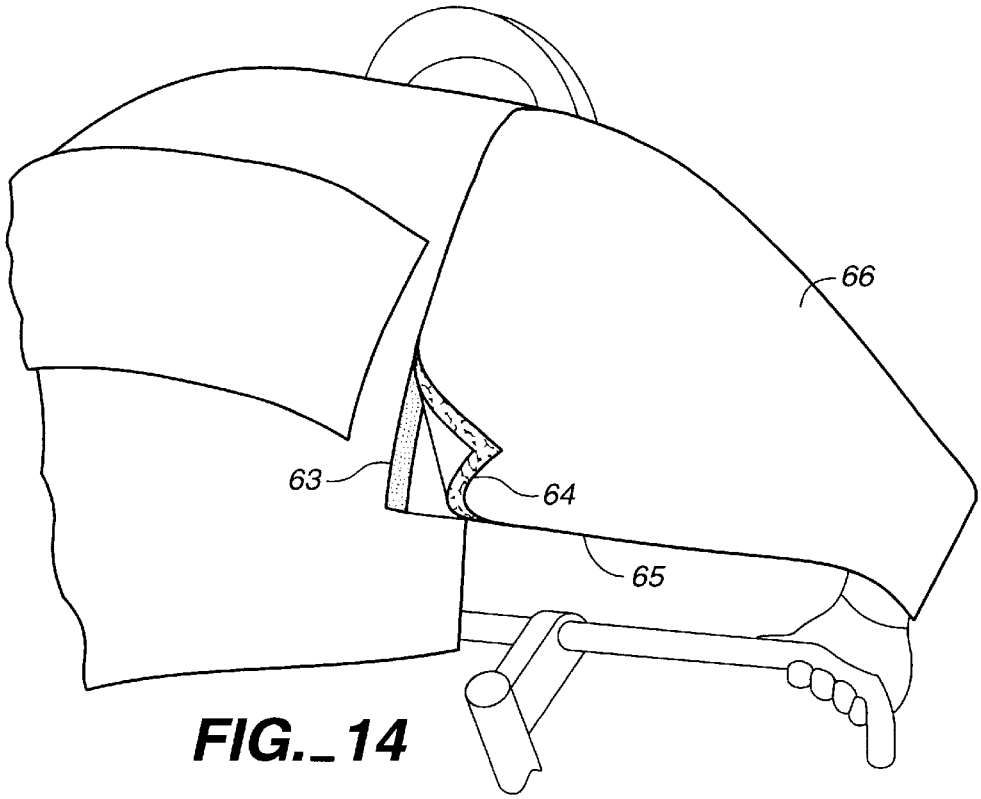
FIG. 14 is a detailed view of the attachment of the wing-like extensions to the abdominal portion by zipper.

Referring to FIG. 14, there is shown an adjustment of the length of the lower surface 65 of the wing-like extension 66 by unzipping the first several inches of the zipping surfaces 63 and 64.

Referring to FIG. 15, there is shown a method of adjustment of the loops 49 and 32 by attachment to the wrist straps, 45 and 29, respectively shown on FIGS. 9 and 10. For convenience, the reference numerals from FIG. 9 will be utilized. The strap 32 is provided with a frictional tape surface 68 and the wrist strap 29 is provided on its outer surface a receiving frictional surface 67. The rider secures the strap 32 after attaching strap 29 to his wrist, through his palm and onto the interlocking surfaces 68 and 67.

Figure 15A:
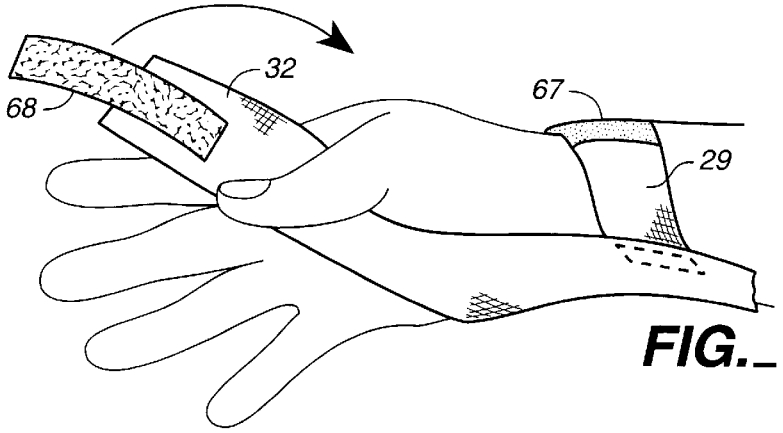
FIGS. 15A–15E show the attachment of the wing-like extensions of the garment by arm and wrist straps and securing of the hand to the garment by a loop which is attachable to the wrist strap.
Figure 15B:
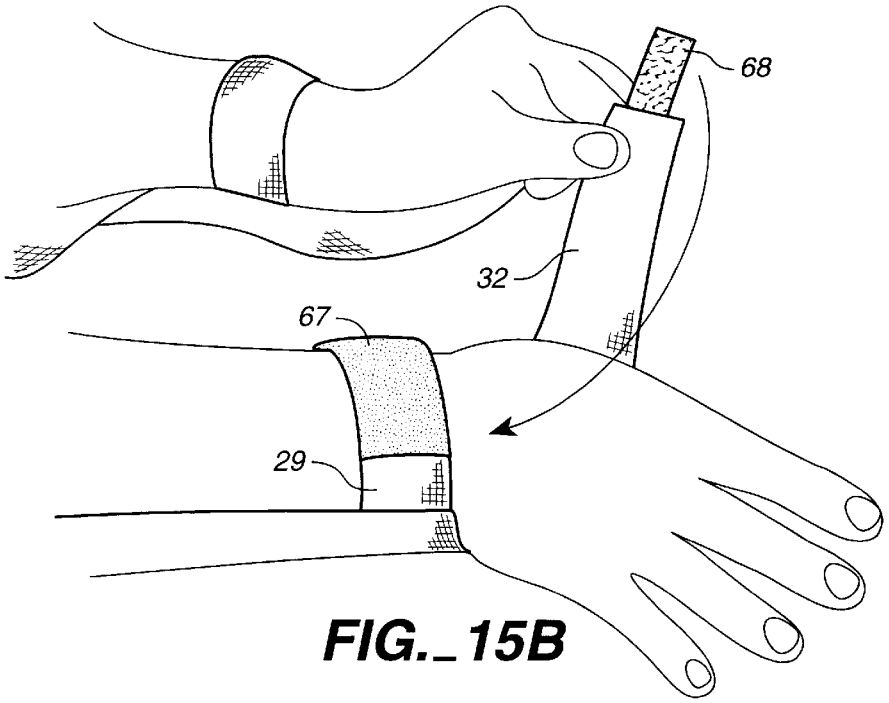
Figure 15C:
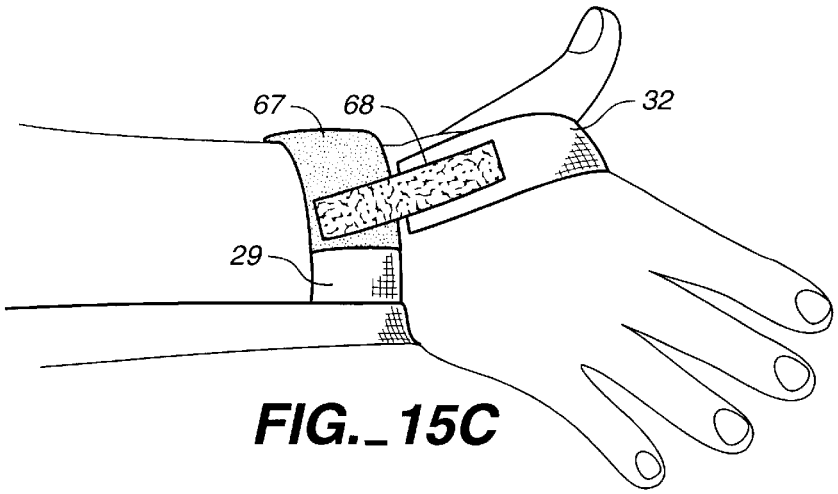
Figure 15D:
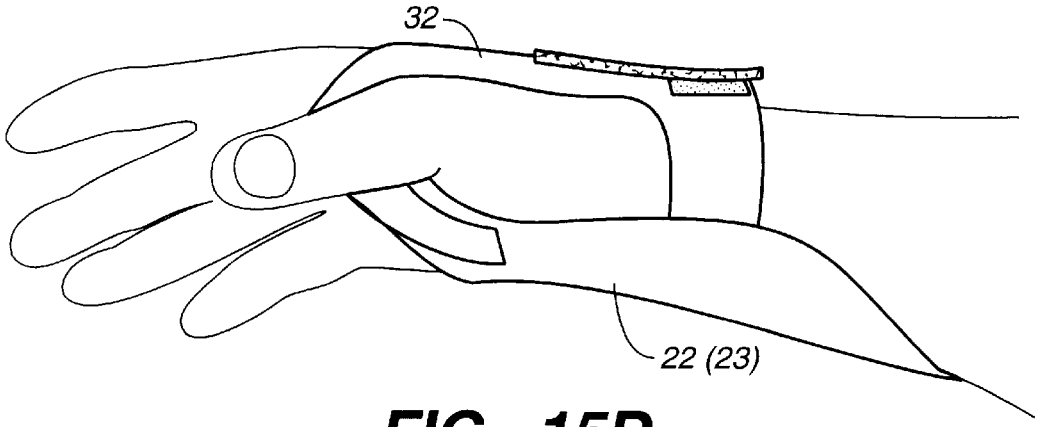
Figure 15E:
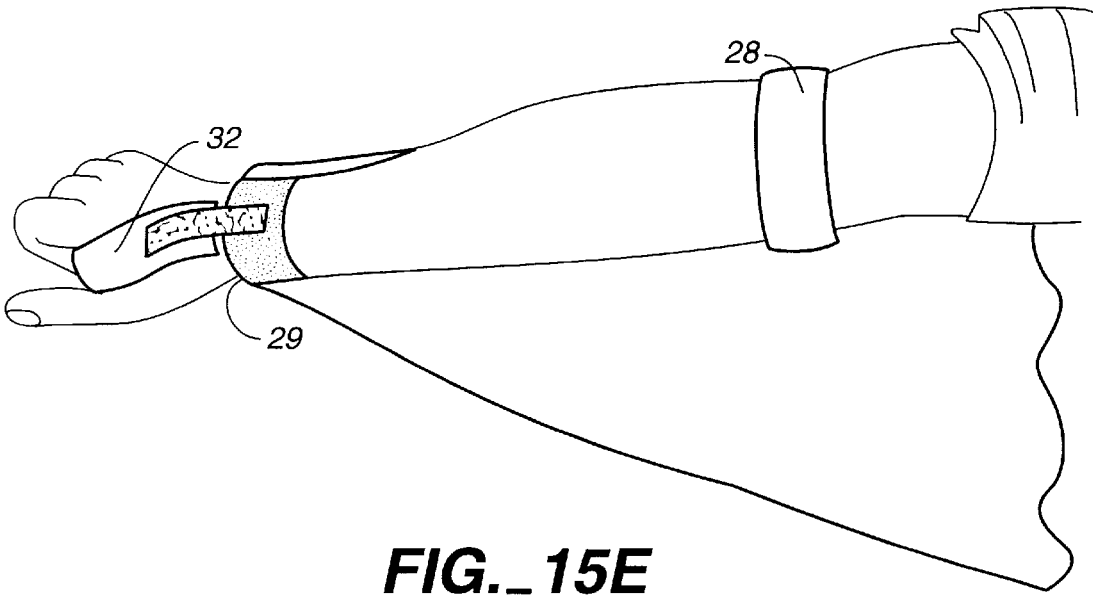

Referring to FIG. 15D, it is preferred that strap 32 be secured tightly enough to bring the end of the wing-like extension 22 or 23 into contact with the palm of the rider's hand. FIG. 15E shows secure attachment of straps 28, 29 and 32 to the arm, wrist and hand of the rider.

Figure 16:
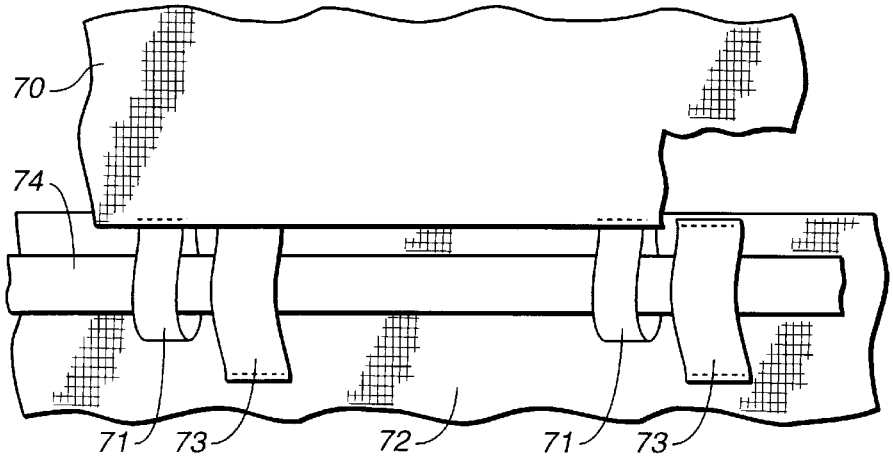
FIG. 16 shows a means of attaching of the upper abdominal portion of the garment of the invention to lower body garment by a belt and loops.
Figure 17:
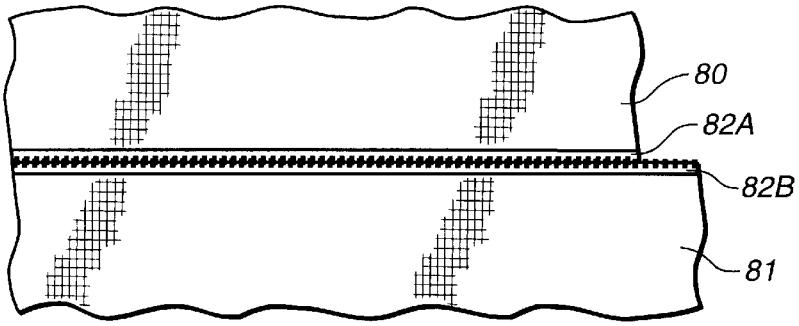
FIG. 17 shows the attachment of the upper abdominal portion of the garment of the invention to a lower body garment by a zipper.
Figure 18:
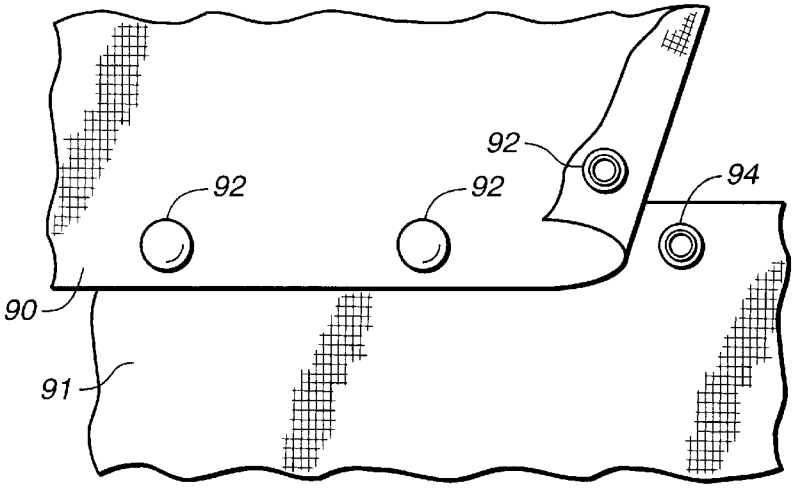
FIG. 18 shows the attachment of the upper abdominal portion of the garment of the invention to a lower body garment by snaps.

In the embodiments of the invention in which the wing-like extensions are only attached to an upper abdominal garment, to prevent the upper abdominal garment from "riding up" the back of the rider during use of the wing-like extensions, it is preferred to provide a means of securing at least the back of the upper abdominal garment to the lower body garment. Shown in the FIGS. 16, 17 and 18 are means of attaching an upper portion of an abdominal garment, such as a shirt, to a lower body garment. FIG. 16 shows an upper abdominal garment 70 having loops 71. The lower garment 72 is provided with loops 73. Loops 71 and 73 are secured by a belt around the waist of the rider.

Referring to FIG. 17, the upper abdominal garment 80 is secured to the lower garment by zipping surfaces 82A and 82B.

Referring to FIG. 18, the upper abdominal garment 90 is provided with snaps 92 which interlock with snaps 94 located on the lower garment 91.

Figure 19:
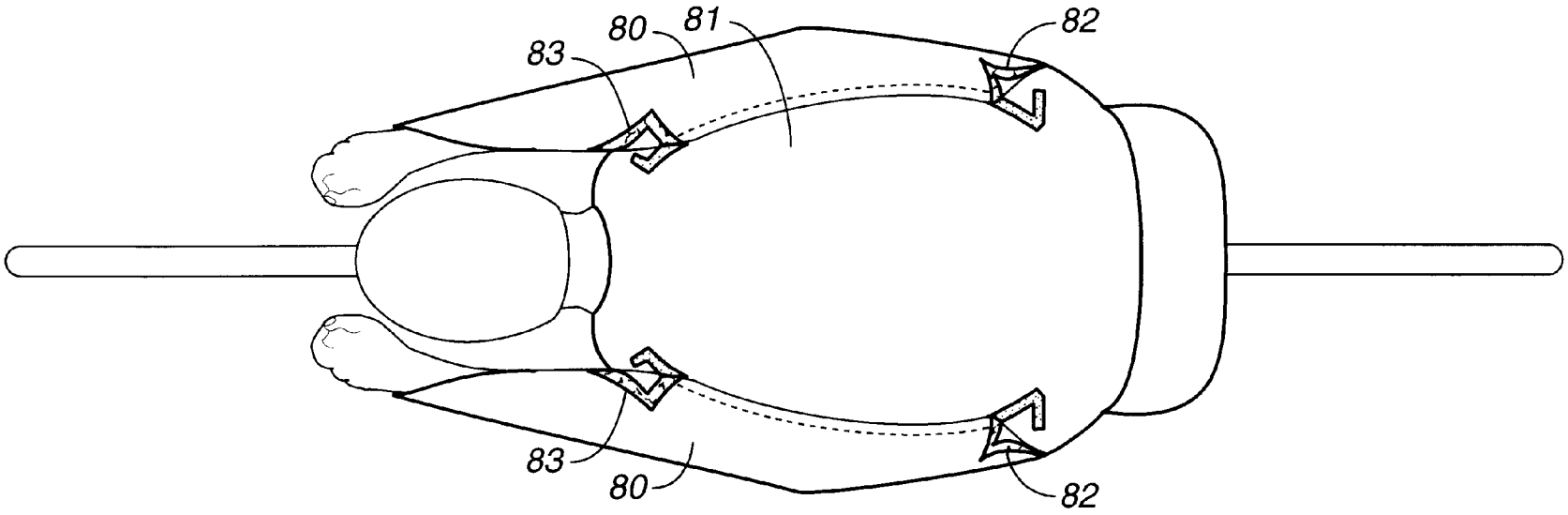
FIG. 19 is a top view of rider on a bicycle showing frictional tape or snaps for adjustment on the shoulders and below waist.

Referring to FIG. 19, there is shown the top view of a rider in an embodiment where the extensions 80 are attached to the abdominal portion 81 by frictional tape, such as VELCRO®. In this embodiment, the lower ends 82 and upper ends 83 of the base of the extensions 80 may be detached in order to allow for adjustment of the length of the extension to accommodate the different sizes of riders.

Figure 20:
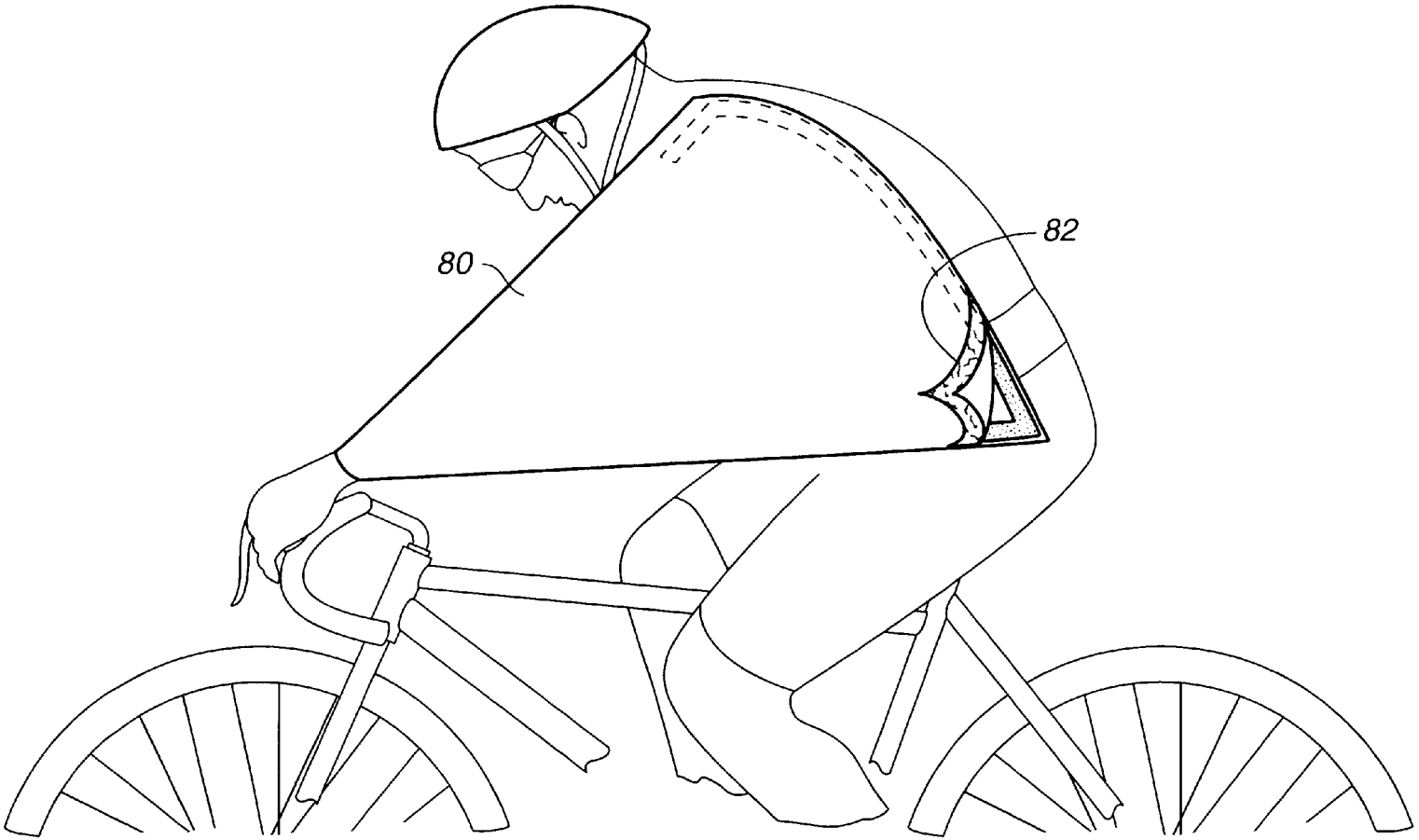
FIG. 20 is a partial side view of a rider on a bicycle showing the fore and aft adjustment by frictional tape below the waist.
Figure 21:
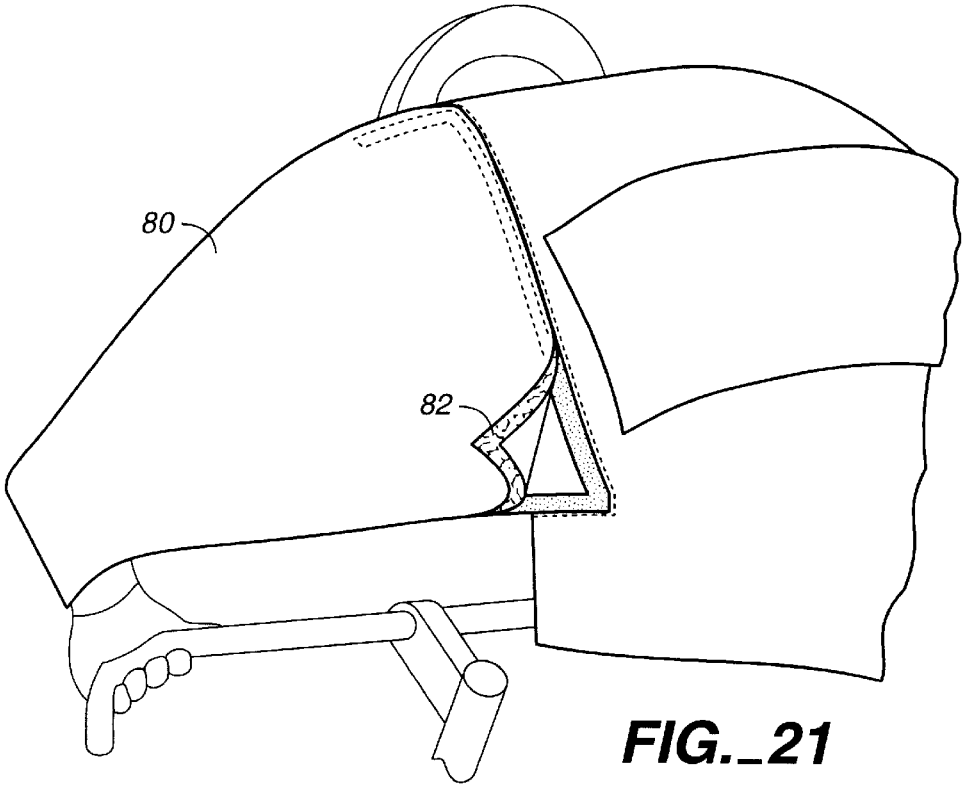
FIG. 21 is a partial rear view of a rider on a bicycle showing the fore and aft adjustment on the left side of the rider.
Figure 22:
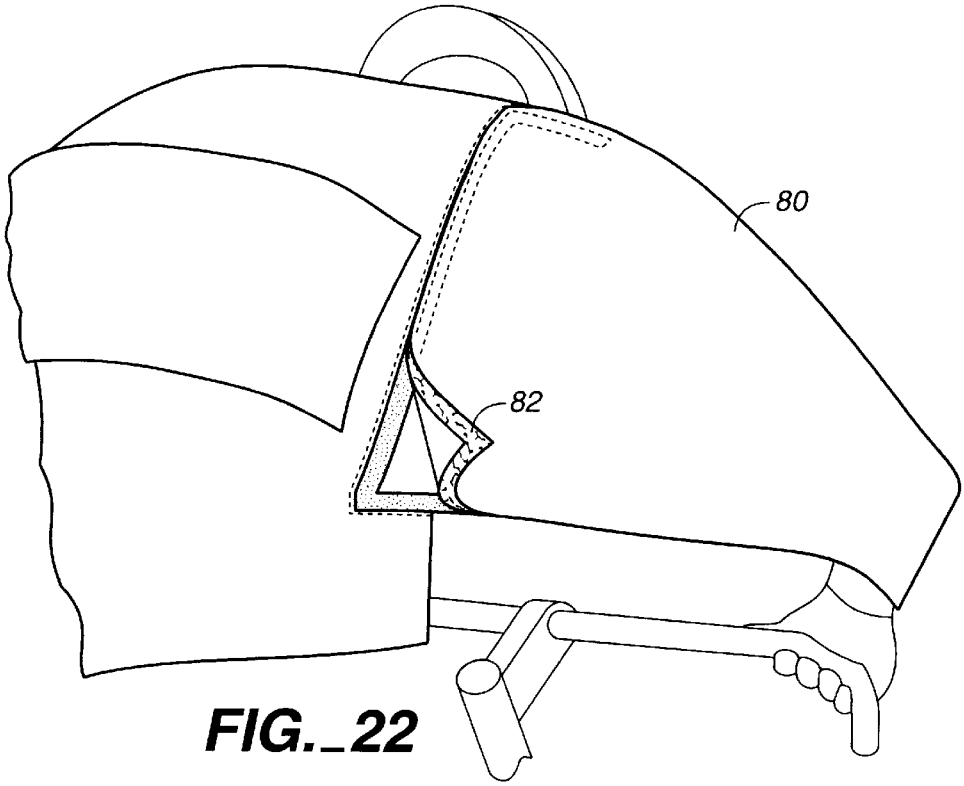
FIG. 22 is a partial rear view of a rider on a bicycle showing the fore and aft adjustment on the right side of the rider.

This is shown in more detail in FIG. 20, where the lower end 82 of the base of extension 80 is shown in a detached position. This is shown again in more detail for the left extension in FIG. 21 and the right extension in FIG. 22. In FIGS. 21 and 22 the rider is shown having his hands on the outer handlebar position with elbows out. In FIG. 20 the rider has his hands on the inner handlebar (such as a position for use of aero-bars).

Figure 23:
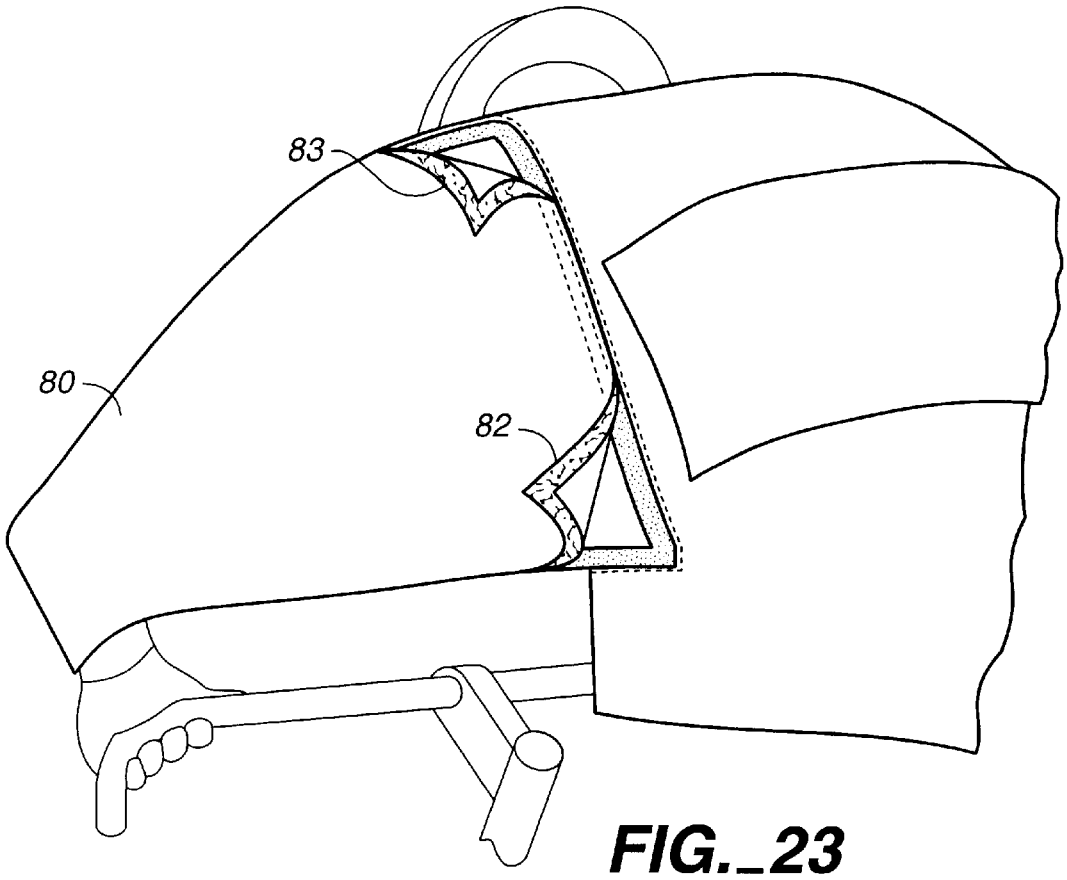
FIG. 23 is a partial rear view of a rider on a bicycle showing the fore and aft adjustment on the shoulder of a rider.

Referring to FIG. 23 there is shown a partial rear view of a rider showing adjustment on the shoulder, wherein the upper corner 83 of the extension 80 is shown to be in a partially detached position, in addition to the lower corner 82, to show the further adjustability of the length of the extension 80 to accommodate the size of the rider and the positional usage of the extension 80.

Figure 24:
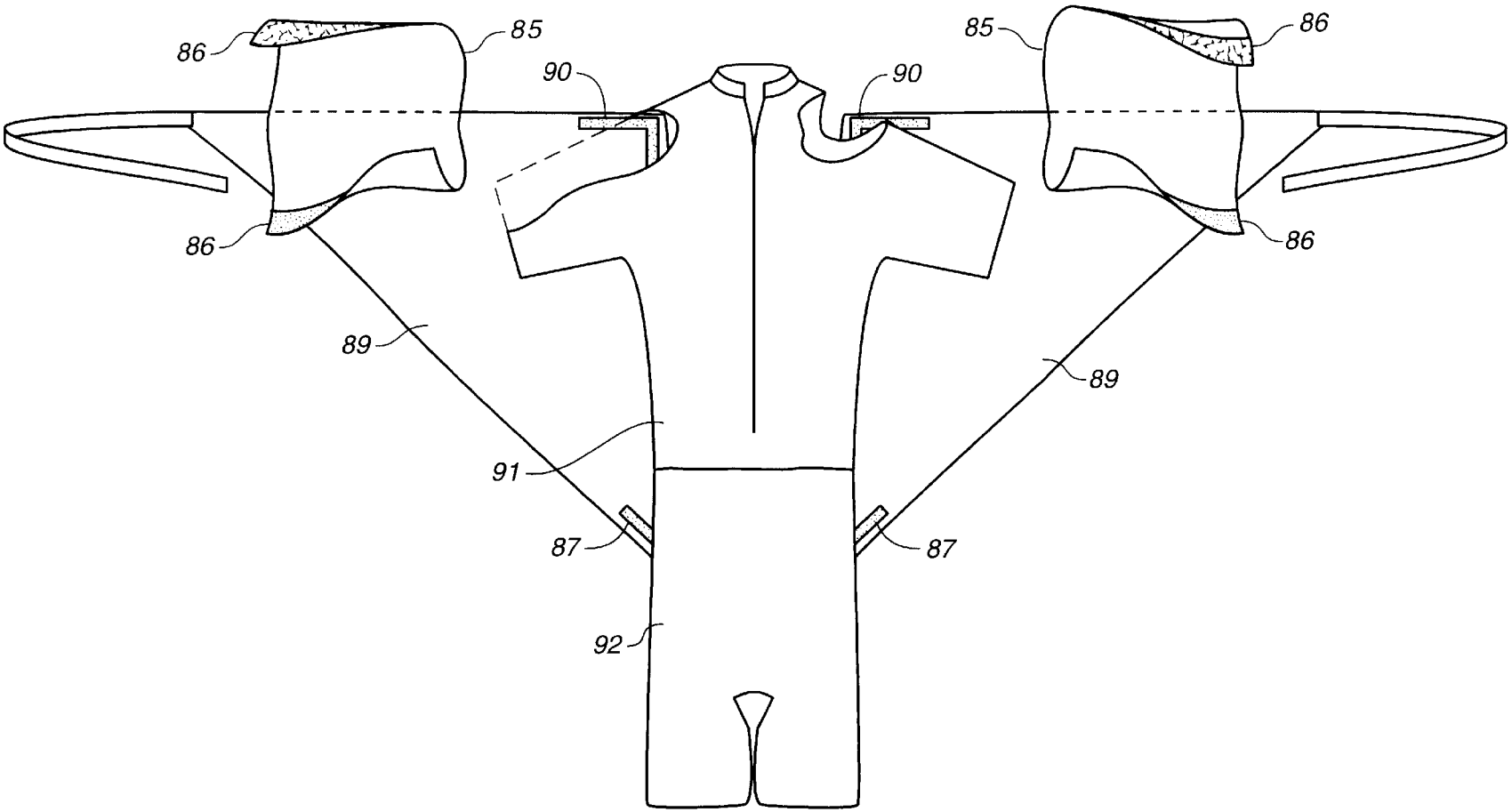
FIG. 24 shows the attachment of the garment extension to the forearm with a two part sleeve on each extension.

Referring to FIG. 24 there is shown an embodiment of the invention having a abdominal portion 91 and a lower body portion 92 attached to form a single body suit. The extensions 89 are attached to the abdominal portion 91 and lower body portion 92 by frictional tape. Portions 87 and 90, as well as longitudinal frictional tape sections (not shown), attach to corresponding frictional tape receiving sections on the back of the abdominal portion 91 and lower body piece 92. The extensions 89 are also provided with sleeves 85 which are provided with frictional tape sections 86 which wrap around the forearms of the rider. Alternatively, the sleeves may be tube-like for insertion of the arm therethrough.

Figure 25:
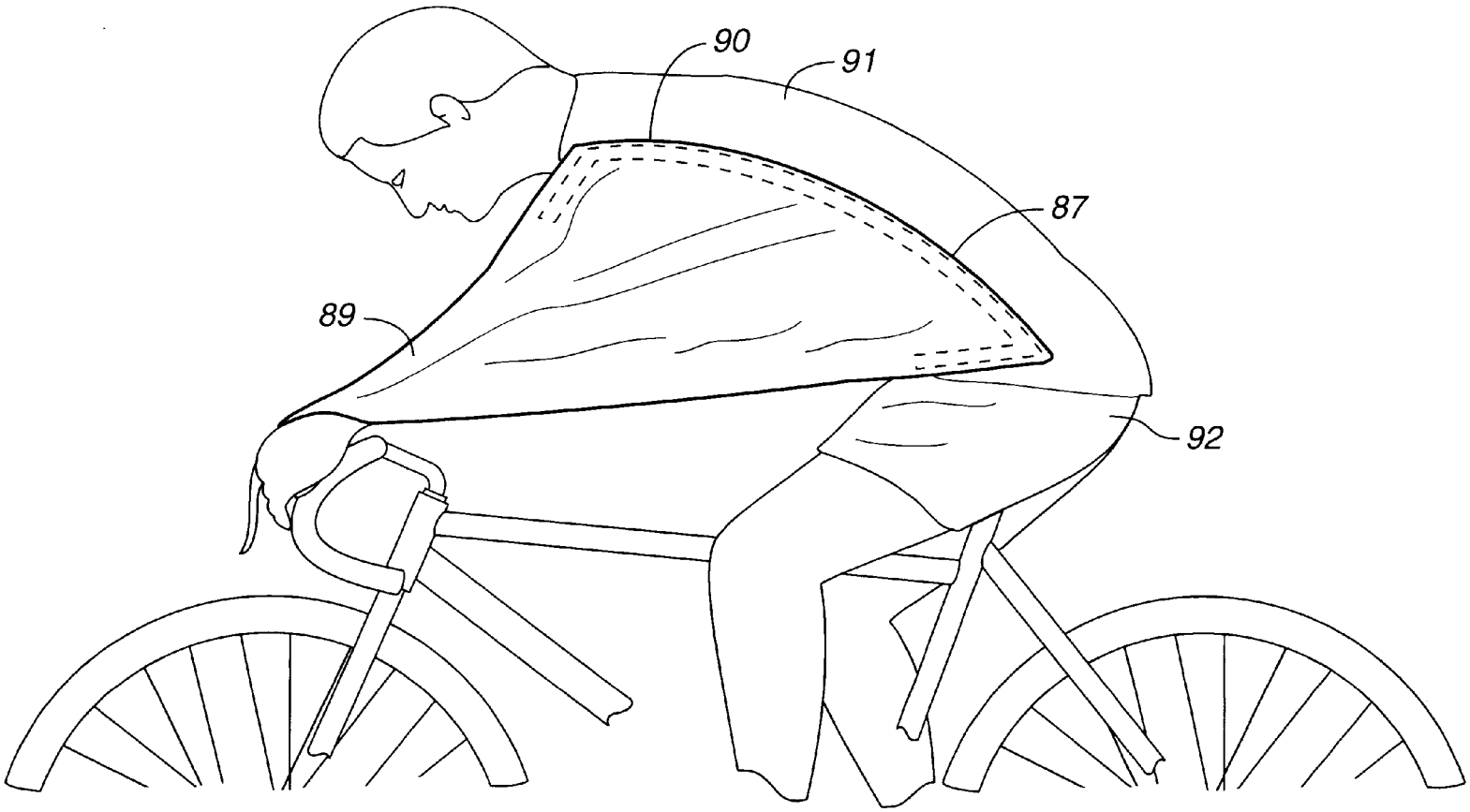
FIG. 25 is a side view of a rider on a bicycle showing the adjusted extensions attached in use on the shoulder and below the waist.

FIG. 25 is a side view of a rider showing the attachment of the lower portion 87 of extension 89 by frictional tape which is located below the waist of the rider on the lower body portion 92. The upper corner 90 is attached by frictional tape to the abdominal body portion of the garment 91.

Figure 26:
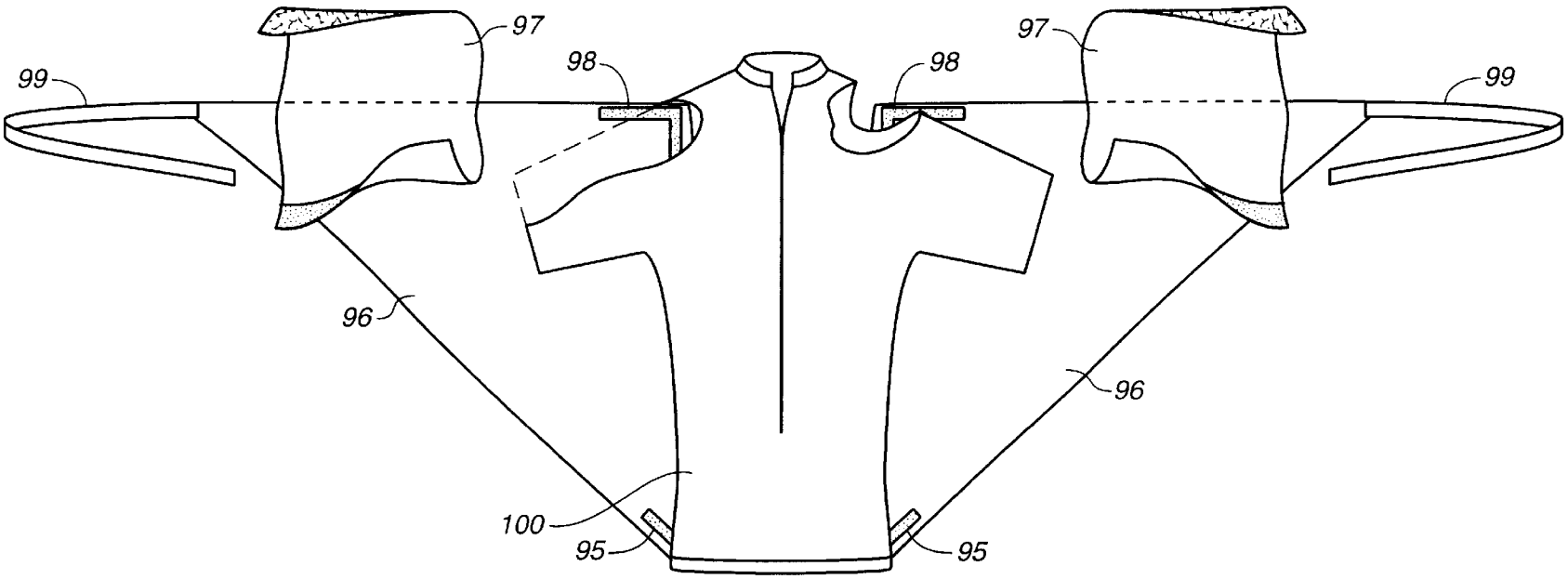
FIG. 26 is a front view of another embodiment of the invention.

FIG. 26 is another embodiment of the invention similar to that of FIG. 24, without the lower body portion 92. In FIG. 26 the lower corners 95 of the base of the extensions 96 are attached at the waist of the abdominal body garment at 100. The extensions 96 are provided with sleeves 97, similar to those described in connection with FIG. 24 and straps 99 for attachment to the hand as previously described.

Figure 27:
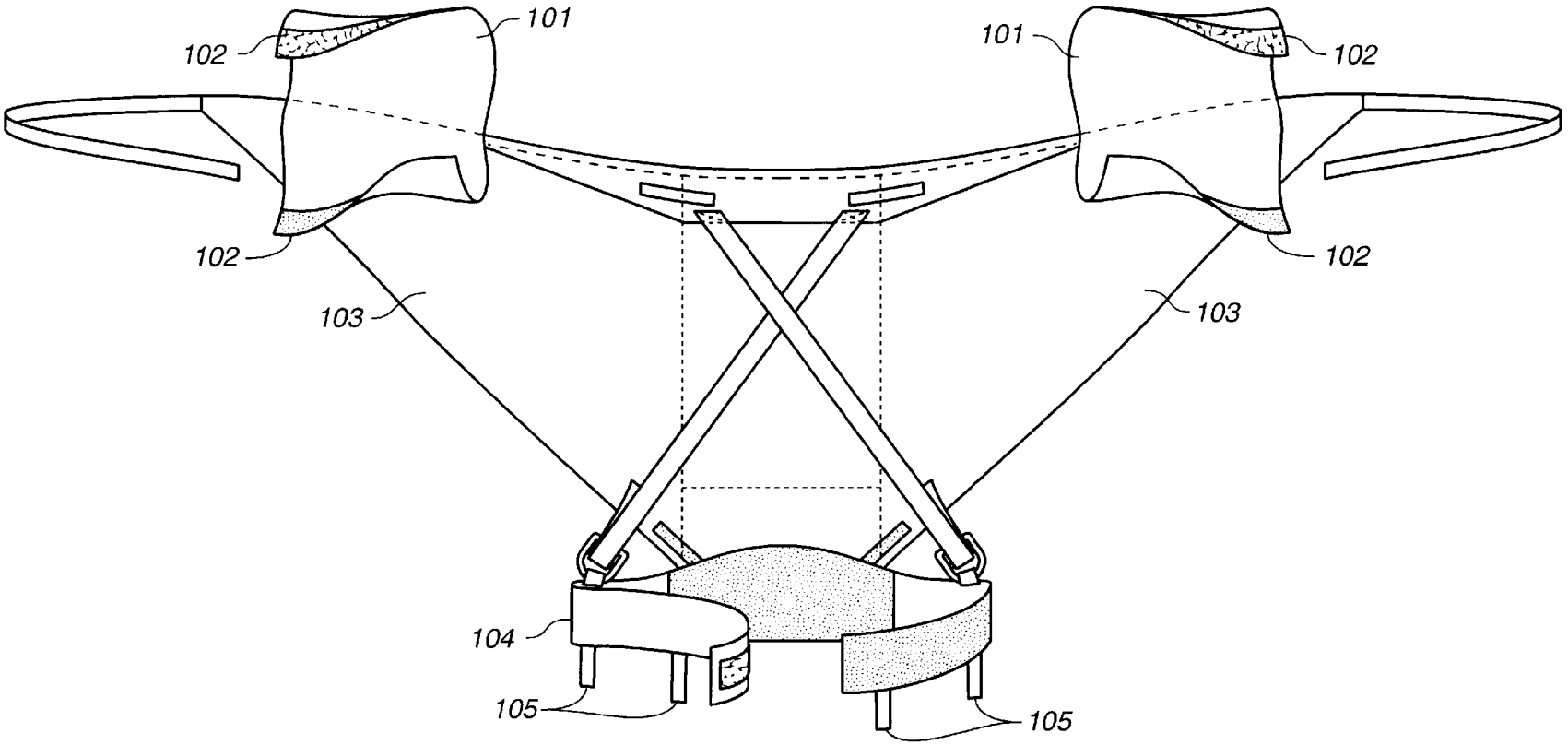
FIG. 27 is an embodiment of the invention showing clips or frictional tape on a belt for attaching the garment of the invention to a bathing suit or shorts.

FIG. 27 shows an embodiment similar to that shown in FIG. 9. The extensions 103 are provided with sleeves 101 having frictional tape surfaces 102 in place of the straps 28 and 29 shown in FIG. 9. In addition, there are shown attachment devices 105 which may be clips or frictional tape surfaces which would be used to attach the belt 104 to shorts or trousers (not shown).

Figure 28:
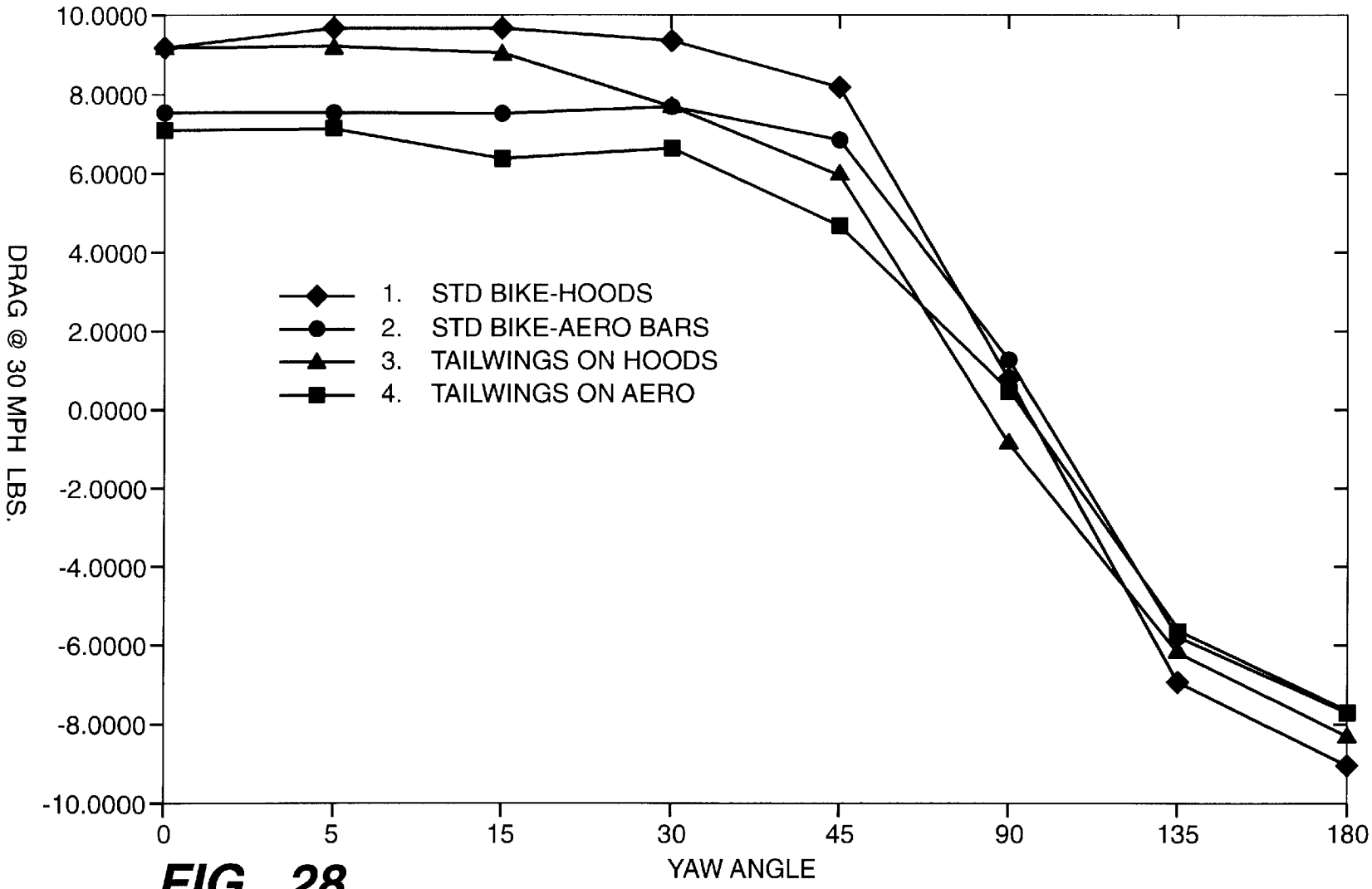
FIG. 28 is a graph of aerodynamic test comparisons described in the example.

Referring to FIG. 28, there is shown a graph of the drag at 30 m.p.h. in pounds versus the yaw angle for tests conducted in a wind tunnel. Four configurations were tested: a rider on a standard bike with his hands on the brake hoods on the handlebars; a rider on a bike with his hands on aero-bars; a rider on a bike wearing the device according to the invention with his hands positioned on the brake hoods of the handlebars; and a rider wearing a garment according to the invention with his hands on aero-bars. This data is discussed in more detail in the example.

Figure 29:
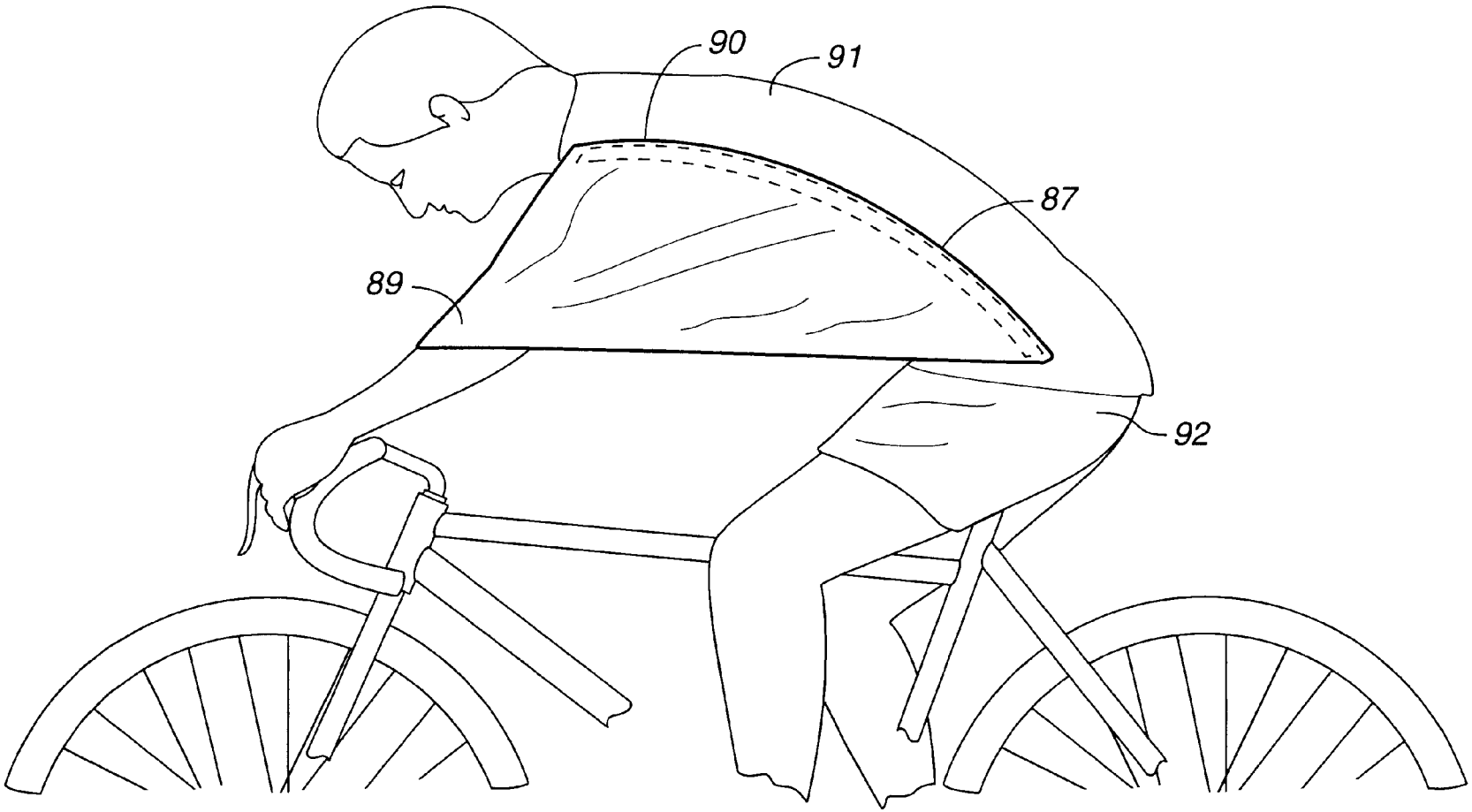
FIG. 29 is a side view of a rider on a bicycle showing the apex attached to the upper forearm.

Referring to FIG. 29, there is shown a side view of a rider with the attachment of the lower portion 87 of extension 89 by frictional tape located below the waist on lower body portion 92. The upper corner 90 is attached by frictional tape to the abdominal body portion of garment 91. In this embodiment, the extension 89 is of a smaller size than that shown in FIG. 25, so the attachment of the apex is near the elbow rather than the hand of the rider.

Figure 30:
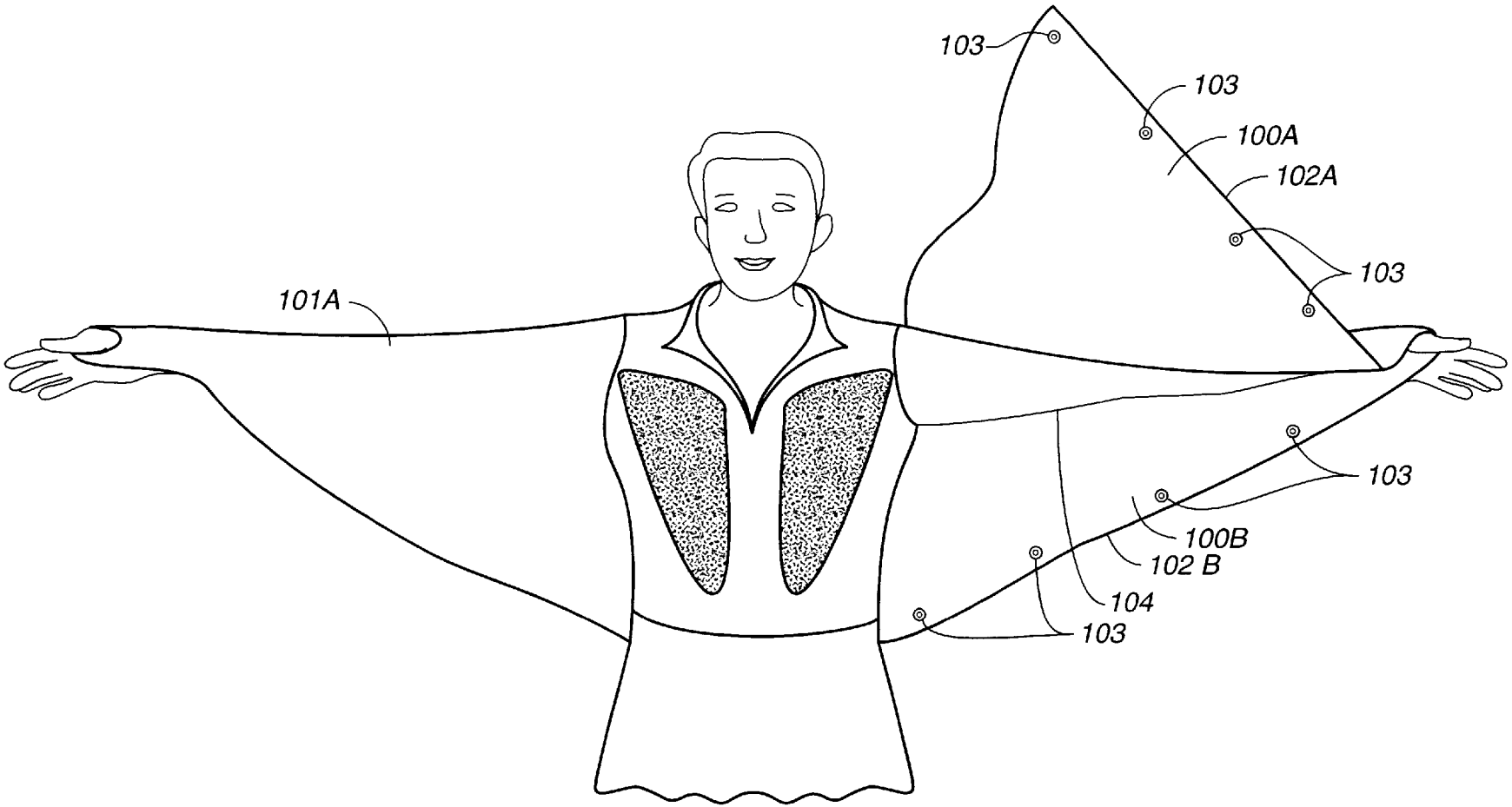
FIG. 30 is a view of another embodiment in which the wing-like extensions each comprise two flaps which attach around the arm to form an airfoil.

Referring to FIG. 30, there is shown another embodiment in which the wing-like extensions comprise two flaps 100A, 100B (and corresponding 101A and 101B (not shown)), which are wrapped around the user's arm to form an airfoil. The wrapped arm of the user forms the leading edge and the secured edges 102A and 102B form the trailing edge of the airfoil. The bottom edges 102A and 102B of flaps 100A and 100B can be sewn together or secured by Velcro® attachments 103. The rider is wearing a device having long sleeves.

Figure 31:
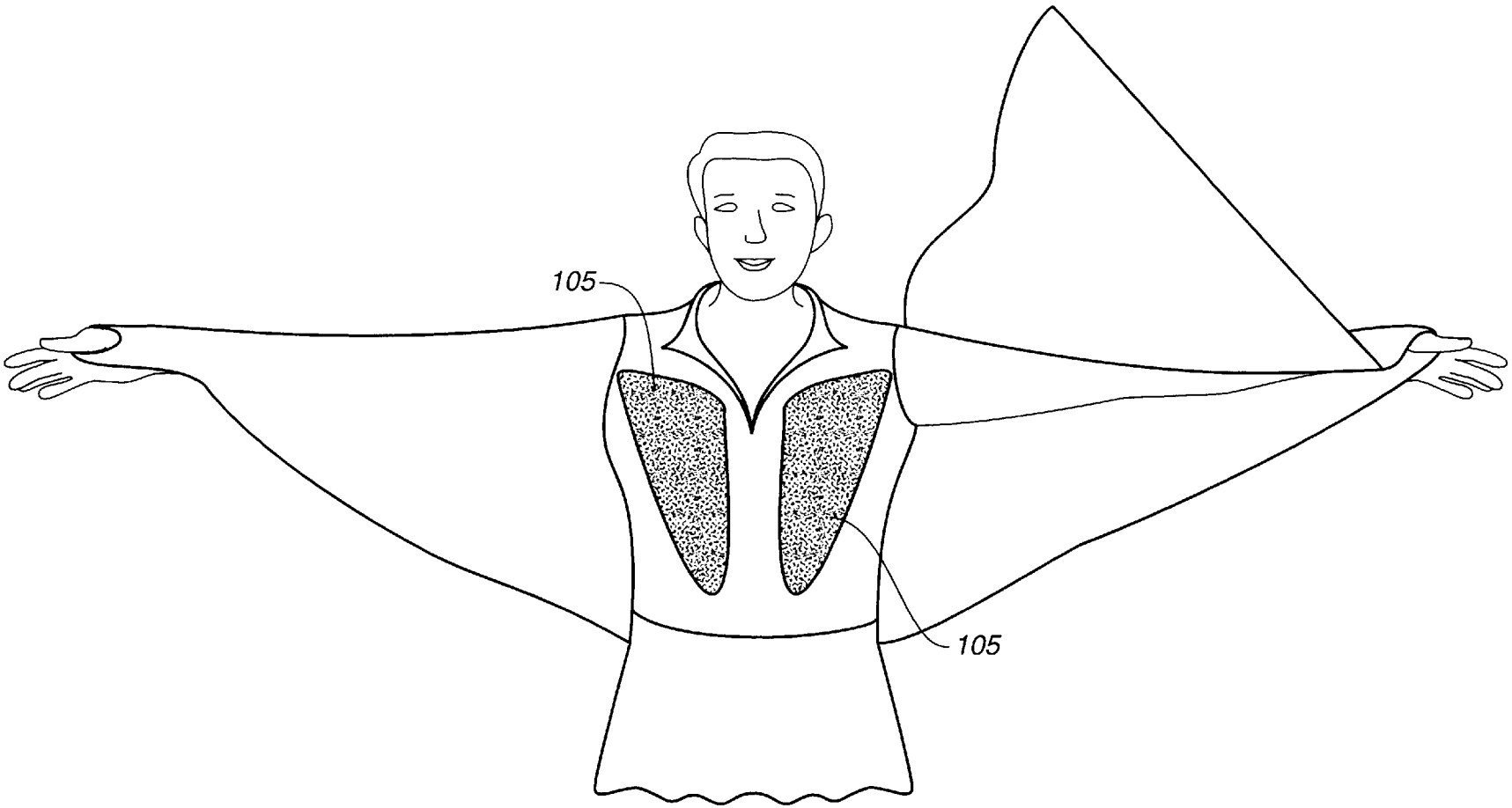
FIG. 31 shows a modification of the device in FIG. 30 having inflatable chest pouches.

Referring to FIG. 31, there is shown a modification of the embodiment of FIG. 30. Inflatable chest pouches 105 are provided to funnel air flow from the chest down the sides of rider to the waist. The pouches way be inflated with air or made to be expandable by filling with a soft material, such as, articles of clothing. This is particularly useful when the user is riding with hands on aero-bars.

Figure 32:
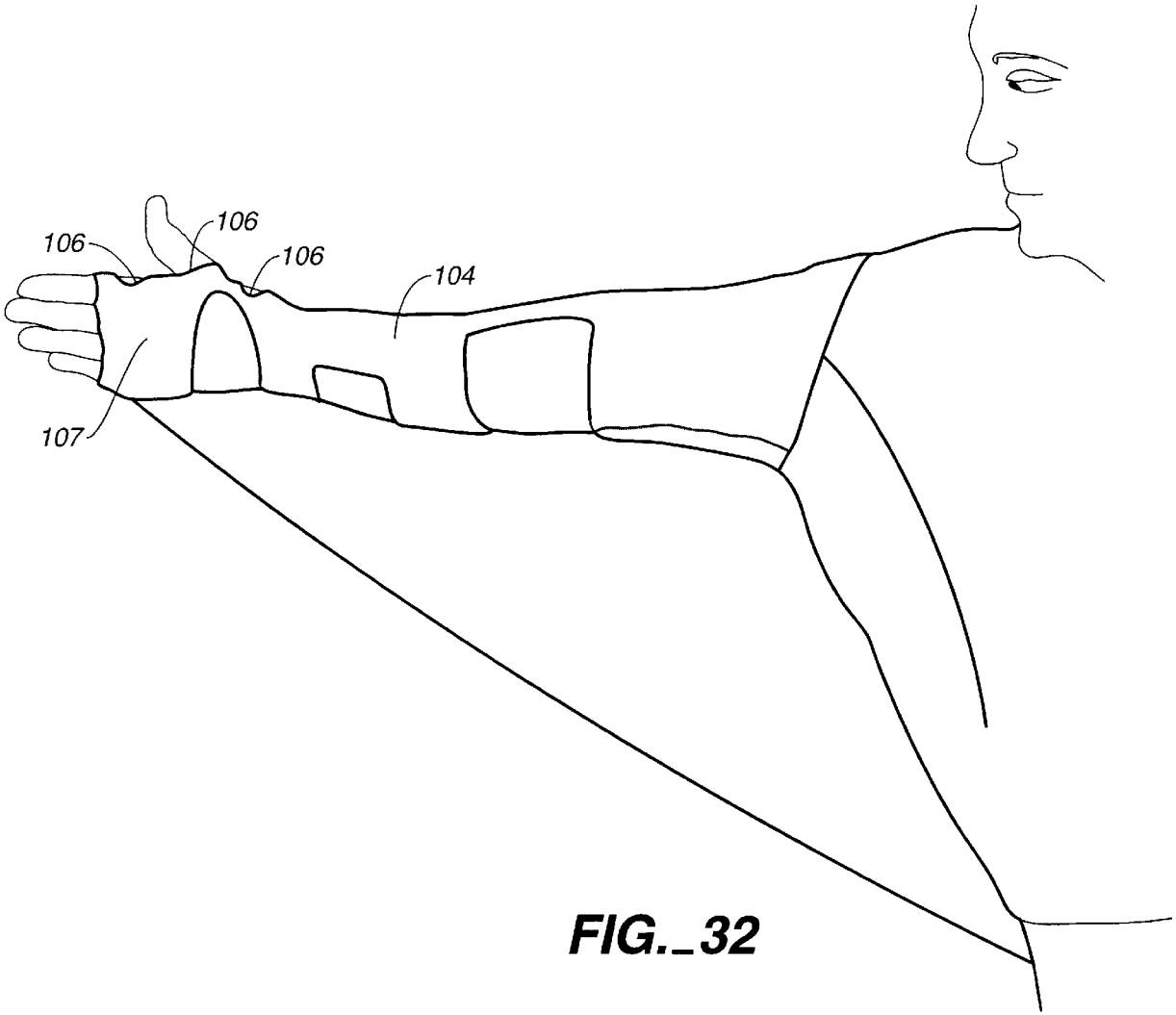
FIG. 32 shows another method of attaching the end of the wing-like extensions through thumb holes.

Referring to FIG. 32, there is disclosed an embodiment for securing the wing-like extensions at the hands through attached glove-like portion 107 having thumb holes 106. The glove-like portion 107 is an integral part of the sleeve

104. Three thumb holes are shown to provide adjustability in accommodating arm lengths and hand sizes.

EXAMPLE

A prototype of the present invention was tested in a low speed wind tunnel. The invention was tested over four hours with advanced bicyclist on a Litespeed™ bicycle.

Referring to FIG. 28, the Y-axis shows the amount of drag at 30 mph. Thus, if a bicyclist is traveling at 20 mph and the apparent wind is 10 mph (the breeze felt while riding the bike comes, for example, from 10° off the direction of travel is the apparent wind), the total wind hitting the bicycle and rider is 30 mph.

The X-axis shows the yaw angle, the angle the wind is coming at the rider and bicycle. Thus 0° is a dead on head-wind, which is very rare. Most winds encountered will be coming at 5°–45°.

The key on the right side of FIG. 28 shows:

1) standard bike—hands on brake hoods
2) standard bike—hands in aero-bars
3) tailwings (the invention) on brake hoods
4) tailwings (the invention) used with aero-bars

RESULTS

The device of the invention (hands on aero bars) reduces drag on every wind direction as compared to a standard bike with the hands on the brake hoods and the device of the invention with the hands on the brake hoods. At 0°, the standard bike and rider is 9.2219 lbs. of drag, while using the device of the invention produces 9.1354 lbs. of drag, a saving of 0.0865 lbs. of drag. At 5°, the standard bike is 9.7141 lbs. of drag as compared to the device of the invention at 9.2771 lbs., a saving of 0.437 lbs. of drag. At 15°, a standard bike is 9.6129 lbs. of drag as compared to 9.1196 with the invention, a saving of 0.4933. At 30°, a standard bike is 9.3631 as compared to the invention of 7.8054 lbs., a saving 1.5577 lbs. of drag. At 45°, a standard bike is 8.2532 as compared to the invention 6.1142, a saving of 2.139 lbs. of drag.

The use of the invention is extremely advantageous when used in conjunction with aero-bars. Thus, at 15°, standard aero-bars produce 7.5676 lbs. of drag. The invention plus aero-bars used together produce 6.3738 lbs. of drag, a saving of 1.1938 lbs. of drag. This saving in drag is maintained essentially intact to 30° yaw. Under all apparent wind conditions as shown in FIG. 28, the invention used with aero-bars produces large reductions in drag.

In wind condition from approximately 30° through 180°, the invention is a significant improvement over aero-bars in reduction of drag.

Referring to Table 1, there is shown a drag-watts comparison chart of the power output of a rider (watts), the drag in lbs., distance (112 miles) and average speed. In Table 2, there is show in the drag-watts comparison for several watt outputs for a 40K distance.

TABLE 1

DRAG - WATTS COMPARISON CHART
Developed By Bicycle Sports Shreveport, LA

| DRAG | WATTS | 112 MILE (181.44 K) | AVG MPH |
|---|---|---|---|
| 5.00 | 250 | 3:59:51 | 28.27 |
| 5.25 | 250 | 4:03:46 | 27.82 |
| 5.50 | 250 | 4:07:34 | 27.39 |
| 5.75 | 250 | 4:11:15 | 26.99 |
| 6.00 | 250 | 4:14:50 | 26.61 |
| 6.25 | 250 | 4:18:19 | 26.25 |
| 6.50 | 250 | 4:21:43 | 25.91 |
| 6.75 | 250 | 4:25:01 | 25.58 |
| 7.00 | 250 | 4:28:15 | 25.27 |
| 7.25 | 250 | 4:31:24 | 24.98 |
| 7.50 | 250 | 4:34:28 | 24.70 |
| 7.75 | 250 | 4:37:29 | 24.43 |
| 8.00 | 250 | 4:40:26 | 24.17 |
| 5.00 | 200 | 4:18:19 | 26.25 |
| 5.25 | 200 | 4:22:33 | 25.83 |
| 5.50 | 200 | 4:26:38 | 25.43 |
| 5.75 | 200 | 4:30:37 | 25.06 |
| 6.00 | 200 | 4:34:28 | 24.70 |
| 6.25 | 200 | 4:38:13 | 24.37 |
| 6.50 | 200 | 4:41:53 | 24.05 |
| 6.75 | 200 | 4:45:26 | 23.75 |
| 7.00 | 200 | 4:48:55 | 23.47 |
| 7.25 | 200 | 4:52:18 | 23.19 |
| 7.50 | 200 | 4:55:37 | 22.93 |
| 7.75 | 200 | 4:58:52 | 22.68 |
| 8.00 | 200 | 5:02:02 | 22.45 |
| 5.00 | 150 | 4:44.18 | 23.85 |
| 5.25 | 150 | 4:48.55 | 23.47 |
| 5.50 | 150 | 4:53.25 | 23.11 |
| 5.75 | 150 | 4:57.47 | 22.76 |
| 6.00 | 150 | 5:02:02 | 22.45 |
| 6.25 | 150 | 5:06:10 | 22.14 |
| 6.50 | 150 | 5:10:11 | 21.85 |
| 6.75 | 150 | 5:14:06 | 21.58 |
| 7.00 | 150 | 5:17:56 | 21.32 |
| 7.25 | 150 | 5:21:40 | 21.07 |
| 7.50 | 150 | 5:25:19 | 20.84 |
| 7.75 | 150 | 5:28:53 | 20.61 |
| 8.00 | 150 | 5:32:22 | 20.39 |
| 5.00 | 100 | 5:25:19 | 20.84 |
| 5.25 | 100 | 5:30:38 | 20.50 |
| 5.50 | 100 | 5:35:48 | 20.18 |
| 5.75 | 100 | 5:40:48 | 19.89 |
| 6.00 | 100 | 5:45:39 | 19.61 |
| 6.25 | 100 | 5:50:23 | 19.34 |
| 6.50 | 100 | 5:54:59 | 19.09 |
| 6.75 | 100 | 5:59:28 | 18.85 |
| 7.00 | 100 | 6:03:51 | 18:63 |
| 7.25 | 100 | 6:08:08 | 18.41 |
| 7.50 | 100 | 6:12:18 | 18.20 |
| 7.75 | 100 | 6:16:23 | 18.00 |
| 8.00 | 100 | 6:20:23 | 17.81 |

TABLE II

40K TIME CHARTS

| WATTS | DRAG | MPH | Approx. 40K Time |
|---|---|---|---|
| 175 | 5.75 | 23.96 | 1:02:51 |
| 175 | 6.00 | 23.62 | 1:03:45 |
| 175 | 6.25 | 23.30 | 1:04:37 |
| 175 | 6.50 | 23.00 | 1:05:27 |
| 175 | 6.75 | 22.71 | 1:06:17 |
| 175 | 7.00 | 22.44 | 1:07:05 |
| 175 | 7.25 | 22.17 | 1:07:52 |
| 175 | 7.50 | 21.93 | 1:08:37 |
| 175 | 7.75 | 21.69 | 1:09:22 |
| 175 | 8.00 | 21.46 | 1:10:06 |
| 175 | 8.25 | 21.24 | 1:10:49 |

TABLE II-continued

40K TIME CHARTS

| WATTS | DRAG | MPH | Approx. 40K Time |
|---|---|---|---|
| 175 | 8.50 | 21.03 | 1:11:31 |
| 175 | 8.75 | 20.83 | 1:12:13 |
| 175 | 9.00 | 20.63 | 1:12:53 |
| 175 | 9.25 | 20.44 | 1:13:33 |
| 175 | 9.50 | 20.26 | 1:14:12 |
| 200 | 5.75 | 25.05 | 1:00:09 |
| 200 | 6.00 | 24.69 | 1:01:00 |
| 200 | 6.25 | 24.36 | 1:01:50 |
| 200 | 6.50 | 24.04 | 1:02:38 |
| 200 | 6.75 | 23.74 | 1:03:25 |
| 200 | 7.00 | 23.46 | 1:04:11 |
| 200 | 7.25 | 23.18 | 1:04:56 |
| 200 | 7.50 | 22.92 | 1:05:40 |
| 200 | 7.75 | 22.67 | 1:06:23 |
| 200 | 8.00 | 22.44 | 1:07:05 |
| 200 | 8.25 | 22.21 | 1:07:46 |
| 200 | 8.50 | 21.99 | 1:08:26 |
| 200 | 8.75 | 21.77 | 1:09:06 |
| 200 | 9.00 | 21.57 | 1:09:44 |
| 200 | 9.25 | 21.38 | 1:10:22 |
| 200 | 9.50 | 21.19 | 1:11:00 |
| 225 | 5.75 | 26.05 | 0:57:51 |
| 225 | 6.00 | 25.68 | 0:58:40 |
| 225 | 6.25 | 25.33 | 0:59:28 |
| 225 | 6.50 | 25.01 | 1:00.15 |
| 225 | 6.75 | 24.69 | 1:01:00 |
| 225 | 7.00 | 24.40 | 1:01:44 |
| 225 | 7.25 | 24.11 | 1:02:27 |
| 225 | 7.50 | 23.84 | 1:03:09 |
| 225 | 7.75 | 23.58 | 1:03:51 |
| 225 | 8.00 | 23.33 | 1:04:31 |
| 225 | 8.25 | 23.10 | 1:05:11 |
| 225 | 8.50 | 22.87 | 1:05:49 |
| 225 | 8.75 | 22.65 | 1:06:27 |
| 225 | 9.00 | 22.44 | 1:07:05 |
| 225 | 9.25 | 22.23 | 1:07:41 |
| 225 | 9.50 | 22.03 | 1:08:17 |
| 250 | 5.75 | 26.98 | 0:55:53 |
| 250 | 6.00 | 26.60 | 0:56:40 |
| 250 | 6.25 | 26.24 | 0:57:26 |
| 250 | 6.50 | 25.90 | 0:58:11 |
| 250 | 6.75 | 25.58 | 0:58:55 |
| 250 | 7.00 | 25.27 | 0:59:37 |
| 250 | 7.25 | 24.97 | 1:00:19 |
| 250 | 7.50 | 24.69 | 1:01:00 |
| 250 | 7.75 | 24.40 | 1:01:33 |
| 250 | 8.00 | 24.17 | 1:02:19 |
| 250 | 8.25 | 23.92 | 1:02:57 |
| 250 | 8.50 | 23.68 | 1:03:34 |
| 250 | 8.75 | 23.45 | 1:04:11 |
| 250 | 9.00 | 23.24 | 1:04:47 |
| 250 | 9.25 | 23.03 | 1:05:22 |
| 250 | 9.50 | 22.82 | 1:05:57 |
| 275 | 5.75 | 27.85 | 0:54:09 |
| 275 | 6.00 | 27.46 | 0:54:55 |
| 275 | 6.25 | 27.09 | 0:55:39 |
| 275 | 6.50 | 26.74 | 0:56:23 |
| 275 | 6.75 | 26.40 | 0:57:05 |
| 275 | 7.00 | 26.08 | 0:57:47 |
| 275 | 7.25 | 25.78 | 0:58:27 |
| 275 | 7.50 | 25.49 | 0:59:07 |
| 275 | 7.75 | 25.21 | 0:59:45 |
| 275 | 8.00 | 24.95 | 1:00:23 |
| 275 | 8.25 | 24.69 | 1:01:00 |
| 275 | 8.50 | 24.45 | 1:01:36 |
| 275 | 8.75 | 24.21 | 1:02:12 |
| 275 | 9.00 | 23.99 | 1:02:47 |
| 275 | 9.25 | 23.77 | 1:03:21 |
| 275 | 9.50 | 23.56 | 1:03:54 |

Extrapolation of results with drag watts comparison tables demonstrates energy saving by use of the invention, or reduction in effort required to travel, at any distance. For example, at 175 watts for 40K (25 miles), at 15 mph, a standard bike produces 9.6129 lbs. of drag, the invention produces 9.1196, a reduction in drag of 0.4933 which translates to a time savings of (1.14:12–1.12:53) 1.59 or about 2 minutes. With today's knowledge of training and nutrition, there are only a few seconds difference between the top contenders, thus, this 1'59" saving is a significant difference.

The time saving produced by the invention is larger in longer trips with aero-bars. A 112 mile trip at 150 watts produces approximately 7.5676 lbs. of drag as compared 6.3738 lbs. of drag with the invention and aero-bars together, a saving of about 1 lb. of drag. Conservatively, this translates into a real time saving of 15.08 minutes.

This invention is also directed toward the recreational rider, who will derive substantial benefit from the ability to ride faster, further and longer with less effort and greater stability, visibility and safety.

A measure of the aero drag saving of the invention can be shown by comparing the drag savings produced by the invention with drag savings produced by other proven aero bicycle components. Thus, the rider with the invention on the brake hoods at 15° yaw will save 0.4933 lbs. of drag as compared to a rider on the brake hoods without the invention. This translates to (16 oz.×0.4933) 7.8928 oz. of drag reduction. Aero wheels at great expense produce 7.5 oz. of drag reduction (230g+230g−140g−110g=210g÷28=7.5 oz.). Thus, the invention alone reduces the drag by more than the effect of front and rear aero wheels combined, while adding much less weight to the rider-bicycle than aero wheels. The invention used together with aero-bars saves approximately 1.19 lbs. or 534 grams of drag from less than 15° yaw to more than 30° yaw. This is more than the sum of drag reduction due to all aero frame sets, aero components, and aero wheels combined. Thus, on the lightest conventional bike, there are 1160 grams to 690 grams saving in drag; on the lightest aero bike, there are 470 grams saving in drag. On the heaviest conventional bike, there are 1460 grams saving in drag and on the heaviest aero bike, there are 890 to 570 grams of drag reduction.

What is claimed is:

1. A garment for aerodynamic assistance for the propulsion of a rider propelled wheeled vehicle, comprising an abdominal portion securely attached to the abdomen of said rider;

at least one furlable triangular-shaped cloth extension extending from said abdominal portion, wherein said extension has a base and an apex and is joined at its base to said abdominal portion along a line extending approximately from a shoulder blade to at least the waist of said rider to form a wing-like shape; and the apex of said triangular-shaped extension terminates at a point between the hand and about the location of the elbow of said rider on the side of said abdomen where said shoulder blade is located;

wherein a securing device for affixing said extension to a digit of said hand or to said arm to retain said extension in an unfurled position is located at said apex.

2. A garment according to claim 1, wherein said garment comprises two of said triangular-shaped extensions, each respectfully joined at its base along a line extending approximately from each respective shoulder blade to at least the waist of said rider to form two wing-like shapes; the apex of each of said triangular-shaped extensions terminating approximately at each respective hand of said rider and a securing device located at each apex for affixing said extension to a digit of the respective hand to retain said extension in an unfurled position.

3. A device according to claim 2 wherein said securing device comprises a strap.

4. A device according to claim 2 wherein said securing device comprises a glove portion having a thumb hole for retaining said extension.

5. A device according to claim 1 or 2 wherein said extensions each comprises a flap wrapping around the respective arm of the user and secured to form an air foil where the wrapped arm of the user forms the leading edge of said airfoil.

6. A device according to claim 1 or 2 further accommodating inflatable pouches located in the chest area of said abdominal portion.

7. A garment according to claim 2, wherein said abdominal portion accommodates at least one pocket for storage of said extensions in a furled position.

8. A garment according to claim 2, wherein said abdominal portion is attached to a lower body portion to form a one piece body garment.

9. A garment according to claim 2, wherein said extensions have points of attachment at each of said apices which are adapted to secure to corresponding points of attachment located on said abdominal portion, so that said extensions can be furled and reversibly secured to said abdominal portion.

10. A garment according to claim 9, wherein said points of attachment comprise frictional tape.

11. A garment according to claim 9, wherein said points of attachment comprise snaps.

12. A garment according to claim 1, wherein said extension is attached to said abdominal portion by a zipper.

13. A garment according to claim 1, wherein said extension is attached to said abdominal portion by frictional tape.

14. A garment according to claim 1, further comprising a plurality of attachment straps for securing said extension in an unfurled position to said rider's arm and wrist.

15. A garment according to claim 1, wherein said strap comprises frictional tape surface at one end, wherein said strap is formable into a loop by securing said end onto a receiving frictional tape surface.

16. A garment according to claim 15, further comprising a wrist attachment strap fixed to said extension, said wrist attachment strap having a receiving frictional tape surface.

17. A garment according to claim 8, wherein said abdominal portion is attached to said lower body portion by zipper.

18. A garment according to claim 8, wherein said abdominal portion is attached to said lower body portion by snaps.

19. A garment according to claim 8, further comprising belt loops on said upper abdominal portion, belt loops on said lower body portion and a belt inserted through said loops to attach said abdominal portion to said lower body portion.

20. A garment according to claim 2, wherein said abdominal portion comprises a belt securable to the waist of said rider and shoulder straps securable to said belt.

21. A garment according to claim 20, wherein said belt and said shoulder straps are adjustable in length to accommodate the size of said rider.

22. A garment according to claim 20, further comprising a plurality of attachment straps for securing said extensions in an unfurled position to said rider's arms and wrists.

23. A garment according to claim 1 further comprising a sleeve for securing said extension in an unfurled position to said rider's arm.

24. A device according to claim 1 or 2 further accommodating expandable pouches located in the chest area of said abdominal portion.

* * * * *